US008301425B2

(12) United States Patent
Dale et al.

(10) Patent No.: US 8,301,425 B2
(45) Date of Patent: Oct. 30, 2012

(54) WELL MODELING ASSOCIATED WITH EXTRACTION OF HYDROCARBONS FROM SUBSURFACE FORMATIONS

(75) Inventors: Bruce A. Dale, Sugar Land, TX (US); Rahul Pakal, Pearland, TX (US); David C. Haeberle, Cypress, TX (US); Jason A. Burdette, Houston, TX (US); John W. Mohr, Victoria (AU); Darren F. Rosenbaum, Doha (QA); Marcus Asmann, Pearland, TX (US); Scott R. Clingman, Houston, TX (US); Brian W. Duffy, Houston, TX (US); Timothy G. Benish, Pearland, TX (US)

(73) Assignee: ExxonMobil Upstream Research Company, Houston, TX (US)

( * ) Notice: Subject to any disclaimer, the term of this patent is extended or adjusted under 35 U.S.C. 154(b) by 580 days.

(21) Appl. No.: 11/922,537

(22) PCT Filed: Jul. 6, 2006

(86) PCT No.: PCT/US2006/026393

§ 371 (c)(1),
(2), (4) Date: Jul. 13, 2010

(87) PCT Pub. No.: WO2007/018860

PCT Pub. Date: Feb. 15, 2007

(65) Prior Publication Data

US 2010/0299111 A1 Nov. 25, 2010

Related U.S. Application Data

(60) Provisional application No. 60/702,761, filed on Jul. 27, 2005.

(51) Int. Cl.
*G06G 7/48* (2006.01)

(52) U.S. Cl. ..... 703/10

(58) Field of Classification Search ..... 703/10
See application file for complete search history.

(56) References Cited

U.S. PATENT DOCUMENTS 5,058,012 A 10/1991 Hinchman et al.

(Continued)

FOREIGN PATENT DOCUMENTS

WO WO 00/50728 A1 8/2000

(Continued)

OTHER PUBLICATIONS

Zhang et al., "An Efficient Reservoir Simulation Approach to Design and Optimize Improved Oil Recovery Processes with Distributed Computing", SPE 94733, SPE Latin American and Caribbean Petroleum Engineering Conference, Jun. 2005, pp. 1-14.*

(Continued)

*Primary Examiner* — Mary C Jacob
*Assistant Examiner* — Aniss Chad
(74) *Attorney, Agent, or Firm* — ExxonMobil Upstream Research Company-Law Department

(57) ABSTRACT

A method and apparatus for producing hydrocarbons is described. In the method, a failure mode for a well completion is identified. A numerical engineering model to describe an event that results in the failure mode is constructed. The numerical engineering model is converted into a response surface. Then, the response surface is associated with a user tool configured to provide the response surface for analysis of another well.

49 Claims, 8 Drawing Sheets

U.S. PATENT DOCUMENTS

| | | | | |
|---|---|---|---|---|
| 5,416,697 | A | 5/1995 | Goodman | |
| 6,088,656 | A | 7/2000 | Ramakrishnan et al. | |
| 6,109,368 | A | 8/2000 | Goldman et al. | |
| 6,182,756 | B1 | 2/2001 | Garcia et al. | |
| 6,196,318 | B1 | 3/2001 | Gong et al. | |
| 6,230,101 | B1 | 5/2001 | Wallis | |
| 6,266,619 | B1 | 7/2001 | Thomas et al. | |
| 6,460,006 | B1 | 10/2002 | Corcoran | |
| 6,549,854 | B1 | 4/2003 | Malinverno et al. | |
| 6,549,879 | B1 | 4/2003 | Cullick et al. | |
| 6,640,190 | B2 | 10/2003 | Nickel | |
| 6,654,692 | B1 | 11/2003 | Neff | |
| 6,662,146 | B1 | 12/2003 | Watts | |
| 6,668,922 | B2 | 12/2003 | Ziauddin et al. | |
| 6,745,159 | B1 | 6/2004 | Todd et al. | |
| 6,766,255 | B2 | 7/2004 | Stone | |
| 6,785,641 | B1 | 8/2004 | Huang | |
| 6,804,609 | B1 | 10/2004 | Brumbaugh | |
| 6,810,332 | B2 | 10/2004 | Harrison | |
| 6,810,370 | B1 | 10/2004 | Watts, III | |
| 6,813,564 | B2 | 11/2004 | Eiken et al. | |
| 6,823,297 | B2 | 11/2004 | Jenny et al. | |
| 6,826,486 | B1 | 11/2004 | Malinverno | |
| 6,836,731 | B1 | 12/2004 | Whalley et al. | |
| 6,840,317 | B2 | 1/2005 | Hirsch et al. | |
| 6,842,700 | B2 | 1/2005 | Poe | |
| 6,892,812 | B2 | 5/2005 | Niedermayr et al. | |
| 6,901,391 | B2 | 5/2005 | Storm, Jr. et al. | |
| 6,980,929 | B2 | 12/2005 | Aronstam et al. | |
| 6,980,940 | B1 | 12/2005 | Gurpinar et al. | |
| 7,054,752 | B2 | 5/2006 | Zabalza-Mezghani et al. | |
| 7,062,420 | B2 | 6/2006 | Poe, Jr. | |
| 7,066,019 | B1 | 6/2006 | Papanastasiou | |
| 7,089,167 | B2 | 8/2006 | Poe | |
| 7,099,811 | B2 | 8/2006 | Ding et al. | |
| 7,177,764 | B2 | 2/2007 | Stone | |
| 7,188,058 | B2 | 3/2007 | Hardy et al. | |
| 7,191,062 | B2 | 3/2007 | Chi et al. | |
| 7,200,539 | B2 | 4/2007 | Ong et al. | |
| 7,561,998 | B2 | 7/2009 | Panga et al. | |
| 7,657,415 | B2 | 2/2010 | Panga et al. | |
| 2002/0013687 | A1 | 1/2002 | Ortoleva | |
| 2002/0049575 | A1 | 4/2002 | Jalali et al. | |
| 2002/0055868 | A1 | 5/2002 | Dusevic et al. | |
| 2002/0084071 | A1 | 7/2002 | McCoy et al. | |
| 2002/0120429 | A1 | 8/2002 | Ortoleva | |
| 2003/0051873 | A1 | 3/2003 | Patzek et al. | |
| 2003/0220775 | A1 | 11/2003 | Jourdan et al. | |
| 2004/0122640 | A1* | 6/2004 | Dusterhoft | 703/10 |
| 2004/0205576 | A1 | 10/2004 | Chikirivao et al. | |
| 2005/0015231 | A1 | 1/2005 | Edwards et al. | |
| 2005/0121197 | A1 | 6/2005 | Lopez de Cardenas et al. | |
| 2005/0149307 | A1 | 7/2005 | Gurpinar et al. | |
| 2005/0199391 | A1 | 9/2005 | Cudmore et al. | |
| 2005/0267719 | A1 | 12/2005 | Foucault | |
| 2005/0273302 | A1 | 12/2005 | Huang et al. | |
| 2005/0273304 | A1 | 12/2005 | Oliver et al. | |
| 2006/0015310 | A1 | 1/2006 | Husen et al. | |
| 2006/0047489 | A1 | 3/2006 | Scheidt et al. | |
| 2006/0085174 | A1 | 4/2006 | Hemanthkumar et al. | |
| 2006/0149518 | A1 | 7/2006 | Oliver et al. | |
| 2007/0156377 | A1 | 7/2007 | Gurpinar et al. | |
| 2007/0271077 | A1 | 11/2007 | Kosmala et al. | |
| 2008/0033656 | A1 | 2/2008 | Herwanger | |
| 2009/0205819 | A1* | 8/2009 | Dale et al. | 166/250.01 |
| 2009/0216508 | A1* | 8/2009 | Dale et al. | 703/10 |

FOREIGN PATENT DOCUMENTS

| | | | |
|---|---|---|---|
| WO | WO 03/072907 | A1 | 9/2003 |
| WO | WO 2004/046503 | A1 | 6/2004 |
| WO | WO 2007/018858 | A2 | 2/2007 |
| WO | WO 2007/018862 | A2 | 2/2007 |

OTHER PUBLICATIONS

Bachman, R. C. et al., "Coupled Stimulation of Reservoir Flow, Geomechanics, and Formation Plugging With Application to High-Rate Produced Water Reinjection", SPE 79695, SPE Reservoir Simulation Symposium, Feb. 3-5, 2003, pp. 1-9, Houston, TX.

Dejean, J. P. and Blanc, G., "Managing Uncertainties on Production Predictions Using Integrated Statistical Methods", SPE 56696, 1999 SPE Annual Technical Conference and Exhibition, Oct. 3-6, 1999, pp. 1-15, Houston, TX.

Marchina, P. and Onaisi, A., "Reservoir-Geomechanics Coupled Simulations: A Powerful Tool for Well Design and Operation in an HP-HT Environment", SPE/IADC 92546, SPE/IADC Drilling Conference, Feb. 23-25, 2005, pp. 1-6, Amsterdam, The Netherlands.

Minkoff, S. E. et al., "Coupled fluid flow and geomechanical deformation modeling", *Journal of Petroleum Science & Engineering*, May 2003, pp. 37-56, vol. 38, No. 1-2.

Portella, R. C. M, et al., "Uncertainty Quantification to Evaluate the Value of Information in a Deepwater Reservoir", SPE 79707, SPE Reservoir Simulation Symposium, Feb. 3-5, 2003, pp. 1-6, Houston, TX.

Salhi, M. A. et al., "Structured Uncertainty Assessment for a Mature Field through the Application of Experimental Design and Response Surface Methods", SPE 93529, 14$^{th}$ SPE Middle East Oil & Gas Show and Conference, Mar. 12-15, 2005, pp. 1-11, Bahrain.

Tiffin, David L. et al., "Drawdown Guidelines for 1-39 Sand Control Completions", SPE 84495, SPE Annual Technical Conference and Exhibition, Oct. 5-8, 2003, pp. 1-10, Denver Colorado.

Tran, D. et al., "New Iterative Coupling Between a Reservoir Simulator and a Geomechanics Module", SPE Journal, Sep. 2004, pp. 362-369.

Wang, F. and White, C. D., "Designed Stimulation for a Detailed 3D Turbidite Reservoir Model", SPE 75515, SPE Gas Technology Symposium, Apr. 30-May 2, 2002, pp. 1-12, Calgary, Alberta, Canada.

Wang, Y. and Lu, B., "A Coupled Reservoir-Geomechanics Model and Applications to Wellbore Stability and Sand Prediction", SPE 69718, 2001 SPE International Thermal Operations and Heavy Oil Symposium, Mar. 12-14, 2001, pp. 1-14, Margarita Venezuela.

Warpinski, N. R. et al., "Effect of Stress and Pressure on Gas Flow Through Natural Fractures", SPE 22666, 66$^{th}$ SPE Annual Technical Conference, Oct. 6-9, 1991, pp. 105-118, Dallas, TX.

Yale, D. P., "Coupled Geomechanics—Fluid Flow Modeling: Effects of Plasticity and Permeability Alteration", SPE/ISRM 78202, SPE/ISRM Rock Mechanics Conference, Oct. 20-23, 2002, pp. 1-10, Irving, Texas.

Yamamoto, K. et al., "A mechanical model of shale instability problems offshore Abu Dhabi", SPE 78494, 10$^{th}$ Abu Dhabi International Petroleum Conference, Oct. 13-16, 2002, pp. 1-12, Abu Dhabi.

Yeten, B. et al., "A Comparison Study on Experimental Design and Response Surface Methodologies", SPE 93347, 2005 SPE Reservoir Simulation Symposium, Jan. 31-Feb. 2, 2005, pp. 1-15, Houston, TX.

European Search Report No. 112982 for related subject matter, dated Dec. 23, 2005, 4 pages.

European Search Report No. 112977 for related subject matter, dated Feb. 10, 2006, 3 pages.

European Search Report No. 112980 for related subject matter, dated Feb. 8, 2006, 2 pages.

PCT International Search Report and Written Opinion for WO 2007/018860, mailed Sep. 26, 2007, 10 pages.

PCT International Search Report and Written Opinion for WO 2007/018862, mailed May 25, 2007, 7 pages.

PCT International Search Report and Written Opinion for WO 2007/018858, mailed Feb. 21, 2007, 7 pages.

* cited by examiner

WELL MODELING ASSOCIATED WITH EXTRACTION OF HYDROCARBONS FROM SUBSURFACE FORMATIONS

CROSS REFERENCE TO RELATED APPLICATIONS

This application is the National Stage of International Application No. PCT/US06/26393, filed Jul. 6, 2006, which claims the benefit of U.S. Provisional Application 60/702,761, filed 27 Jul. 2005.

BACKGROUND

This section is intended to introduce the reader to various aspects of art, which may be associated with exemplary embodiments of the present techniques, which are described and/or claimed below. This discussion is believed to be helpful in providing the reader with information to facilitate a better understanding of particular aspects of the present techniques. Accordingly, it should be understood that these statements are to be read in this light, and not necessarily as admissions of prior art.

The production of hydrocarbons, such as oil and gas, has been performed for numerous years. To produce these hydrocarbons, one or more wells of a field are typically drilled into a subsurface location, which is generally referred to as a subterranean formation or basin. The process of producing hydrocarbons from the subsurface location typically involves various phases from a concept selection phase to a production phase. Typically, various models and tools are utilized in the design phases prior to production of the hydrocarbons to determine the locations of wells, estimate well performance, estimation of reserves, and plan for the development of the reserves. In addition, the subsurface formation may be analyzed to determine the flow of the fluids and structural properties or parameters of rock geology. In the production phase, the wells operate to produce the hydrocarbons from the subsurface location.

Generally, the phases from concept selection to production are performed in serial operations. Accordingly, the models utilized in the different phases are specialized and directed to a specific application for that phase. As a result of this specialization, the well models employed in different phases typically use simplistic assumptions to quantify well performance potential, which introduce errors in the well performance evaluation and analysis. The errors in the prediction and/or assessment of well performance may impact economics for the field development. For example, during one of the well design phases, such as a well completion phase, failure to accurately account for the effects of well completion geometry, producing conditions, geomechanical effects, and changes in produced fluid compositions may result in estimation errors of production rates. Then, during the subsequent production phase, the actual production rates and well performance may be misinterpreted because of the errors in simplified well performance models. As a result, well remedial actions (i.e., well workovers), which are costly and potentially ineffective, may be utilized in attempts to stimulate production from the well.

Further, other engineering models may be specifically designed for a particular application or development opportunity. These models may be overly complicated and require large amounts of time to process the specific information for the particular application. That is, the engineering models are too complex and take considerable amounts of time to perform the calculations for a single well of interest. Because these models are directed at specific application or development opportunities, it is not practical or possible to conduct different studies to optimize the well completion design and/or use the engineering model to ensure that each well is producing at its full capacity.

Accordingly, the need exists for a method and apparatus to model well performance for prediction, evaluation, optimization, and characterization of a well in various phases of the well's development based on a coupled physics model.

Other related material may be found in WO 00/50728, published Aug. 31, 2000; SALHI A. et al., "Structured Uncertainty Assessment for a Mature Field Through the Application of Experimental Design and Response Surface Methods", SPE 93529, Mar. 12, 2005; DEJEAN J. et al., "Managing uncertainties on production predictions using integrated statistical methods", SPE 56696, Oct. 3, 1999; US 2003/051873, Mar. 20, 2003; FENG WANG et al., "Designed simulation for a detailed 3D turbidite reservoir model", SPE 75515, Apr. 30, 2002.

SUMMARY OF INVENTION

In one embodiment, a method associated with the production of hydrocarbons is described. In this method, a failure mode for a well completion is identified. A numerical engineering model to describe an event that results in the failure mode is constructed. The numerical engineering model is converted into a response surface. Then, the response surface is associated with a user tool configured to provide the response surface for analysis of another well.

In an alternative embodiment, an apparatus is disclosed. The apparatus includes a processor with a memory coupled to the processor and an application that is accessible by the processor. The application is configured to receive parameters associated with a failure mode of a well completion from a user; utilize a previously generated response surface to provide a technical limit for the failure mode, wherein the previously generated response surface is based on at least one numerical engineering model that represents an event resulting in the failure mode; and provide an output that represents the technical limit to the user.

BRIEF DESCRIPTION OF THE DRAWINGS

The foregoing and other advantages of the present technique may become apparent upon reading the following detailed description and upon reference to the drawings in which.

DETAILED DESCRIPTION

In the following detailed description, the specific embodiments of the present invention will be described in connection with its preferred embodiments. However, to the extent that the following description is specific to a particular embodiment or a particular use of the present techniques, this is intended to be illustrative only and merely provides a concise description of the exemplary embodiments. Accordingly, the invention is not limited to the specific embodiments described below, but rather, the invention includes all alternatives, modifications, and equivalents falling within the true scope of the appended claims.

The present technique is direct to a user tool for use in well performance for prediction, evaluation, optimization, and characterization of a well. Under the present technique, the user tool is based on response surfaces previously generated from multiple sets of detailed physics based engineering model simulations. These response surfaces are developed for well producibility limits, and well operability limits. A response surface is a set of equations or algorithms created from the data associated with one or more physics based engineering model simulations. These response surfaces are stored in memory and accessible through a user tool. Beneficially, the user tool provides a user access to the detailed physics governing well operability and producibility limits without the user having to utilize a detailed engineering simulation model. That is, the user does not have to perform the detailed physics based engineering model simulations, but may access previously performed simulations of the detailed physics based engineering model for another well in various phases of the well's development. As such, the user tool enhances the process of well performance prediction, evaluation, and characterization during various aspects of well's life cycle thereby enhances production of hydrocarbons by providing physics based engineering tools in an efficient manner.

Figure 1:
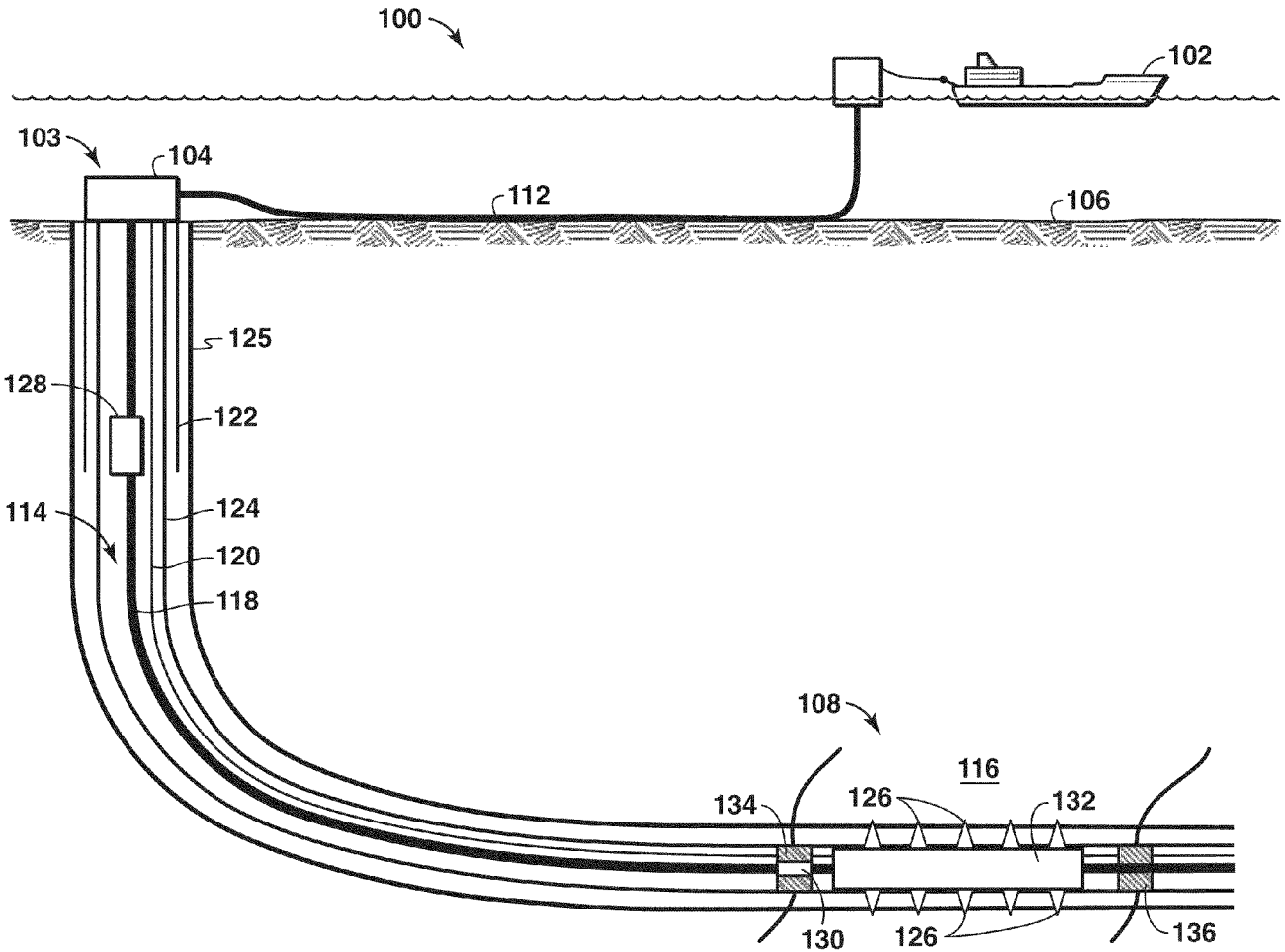
FIG. 1 is an exemplary production system in accordance with certain aspects of the present techniques.

Turning now to the drawings, and referring initially to FIG. 1, an exemplary production system 100 in accordance with certain aspects of the present techniques is illustrated. In the exemplary production system 100, a floating production facility 102 is coupled to a well 103 having a subsea tree 104 located on the sea floor 106. To access the subsea tree 104, a control umbilical 112 may provide a fluid flow path between the subsea tree 104 and the floating production facility 102 along with a control cable for communicating with various devices within the well 103. Through this subsea tree 104, the floating production facility 102 accesses a subsurface formation 108 that includes hydrocarbons, such as oil and gas. However, it should be noted that the production system 100 is illustrated for exemplary purposes and the present techniques may be useful in the production of fluids from any location. To access the subsurface formation 108, the well 103 penetrates the sea floor 106 to form a wellbore 114 that extends to and through at least a portion of the subsurface formation 108. As may be appreciated, the subsurface formation 108 may include various layers of rock that may or may not include hydrocarbons and may be referred to as zones. In this example, the subsurface formation 108 includes a production zone or interval 116. This production zone 116 may include fluids, such as water, oil and/or gas. The subsea tree 104, which is positioned over the wellbore 114 at the sea floor 106, provides an interface between devices within the wellbore 114 and the floating production facility 102. Accordingly, the subsea tree 104 may be coupled to a production tubing string 118 to provide fluid flow paths and a control cable 120 to provide communication paths, which may interface with the control umbilical 112 at the subsea tree 104.

The wellbore 114 may also include various casings to provide support and stability for the access to the subsurface formation 108. For example, a surface casing string 122 may be installed from the sea floor 106 to a location beneath the sea floor 106. Within the surface casing string 122, an intermediate or production casing string 124 may be utilized to provide support for walls of the wellbore 114. The production casing string 124 may extend down to a depth near or through the subsurface formation 108. If the production casing string 124 extends through the subsurface formation 108, then perforations 126 may be created through the production casing string 124 to allow fluids to flow into the wellbore 114. Further, the surface and production casing strings 122 and 124 may be cemented into a fixed position by a cement sheath or lining 125 within the wellbore 114 to provide stability for the well 103 and subsurface formation 108.

To produce hydrocarbons from the subsurface formation 108, various devices may be utilized to provide flow control and isolation between different portions of the wellbore 114. For instance, a subsurface safety valve 128 may be utilized to block the flow of fluids from the production tubing string 118 in the event of rupture or break in the control cable 120 or control umbilical 112 above the subsurface safety valve 128. Further, the flow control valve 130 may be a valve that regulates the flow of fluid through the wellbore 114 at specific locations. Also, a tool 132 may include a sand screen, flow control valve, gravel packed tool, or other similar well completion device that is utilized to manage the flow of fluids from the subsurface formation 108 through the perforations 126. Finally, packers 134 and 136 may be utilized to isolate specific zones, such as the production zone 116, within the annulus of the wellbore 114.

As noted above, the various phases of well development are typically performed as serial operations that utilize specialized or overly simplified models to provide specific information about the well 103. For the simplistic models, general assumptions about certain aspects of the well 103 results in errors that may impact field economics. For example, compaction is a mechanical failure issue that has to be addressed in weak, highly compressible subsurface formation 108. Typically, compaction is avoided by restricting the flowing bottom hole pressure of the well based upon hog's laws or rules of thumb. However, no technical basis supports this practice, which limits the production of hydrocarbons from the well. In addition, faulty assumptions during the well design phases may result in the actual production rates being misinterpreted during the production phase. Accordingly, costly and potentially ineffective remedial actions may be utilized on the well 103 in attempts to stimulate production.

Further, complicated models that account for the physical laws governing well performance are time consuming, computationally intensive, and developed for particular well of interest. Because these complicated models are directed to a specific application, it is not practical to conduct different studies to optimize the completion design and/or ensure that other wells are producing at full capacity based upon these models. For example, a field may include numerous wells that produce hydrocarbons on a daily basis. It is not practical to utilize the complicated models to prevent well failures and optimize the performance of each well. Also, it is unreasonable to utilize the complicated models during each phase of the development of the well because the time associated with the analysis or processing of the data. As such, the complicated models leave many wells unevaluated for potential failures and maintained in a non-optimized state.

Beneficially, the present technique is directed to a user tool that models well performance prediction, evaluation, optimization, and characterization of a well. Under the present technique, the engineering model based response surfaces provide physics based well producibility limits and well operability limits. Alternatively, engineering coupled physics simulators are used to develop coupled physics technical limits. The well producibility limit along with the well operability limit and the coupled physics limits are used to develop integrated well performance limits, which are discussed below in greater detail. The response surfaces may be utilized to efficiently evaluate the well through each of the different phases of the well's development. Accordingly, an exemplary embodiment of the user tool is discussed in greater detail in FIG. 2.

Figure 2:
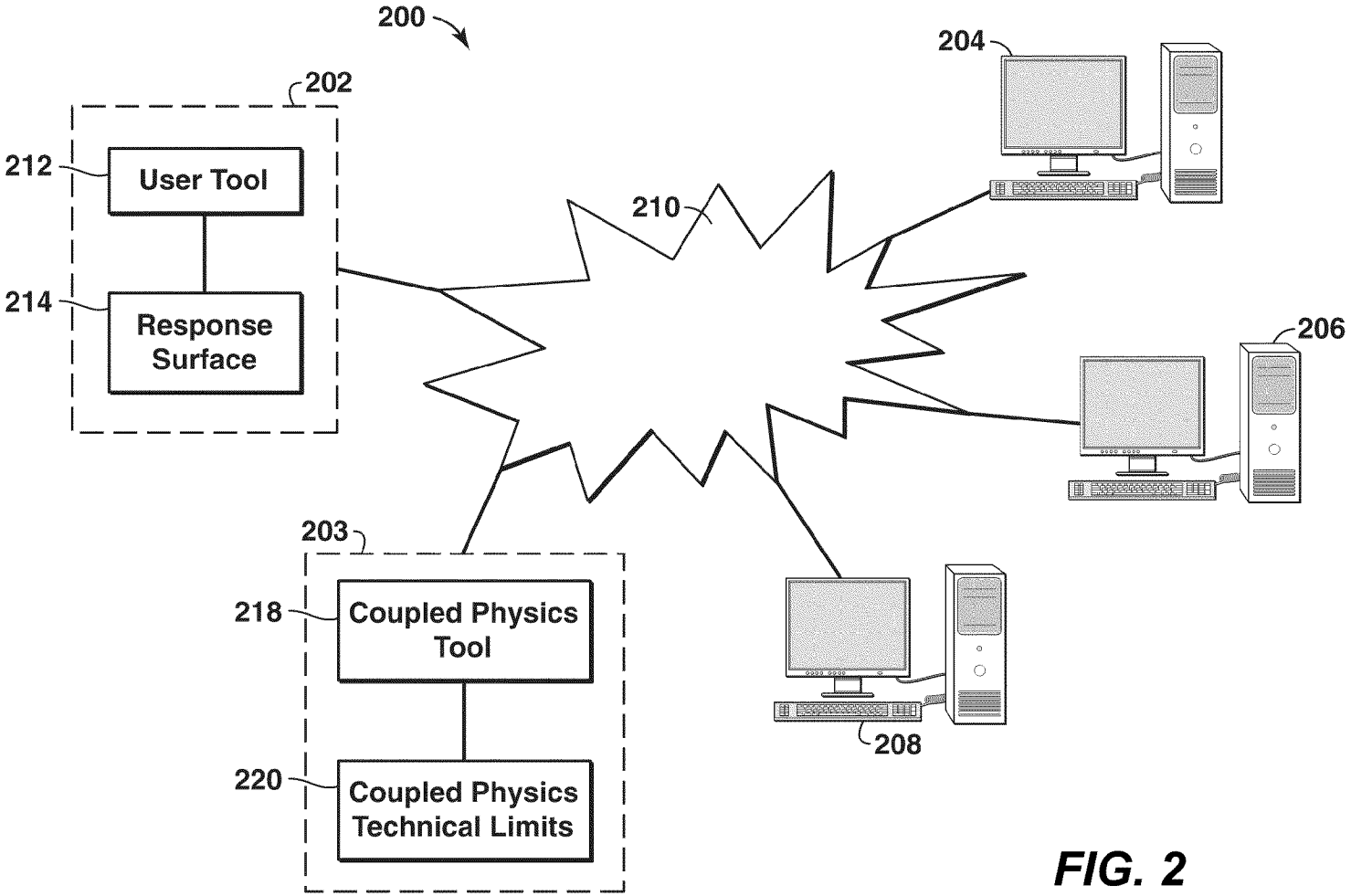
FIG. 2 is an exemplary modeling system in accordance with certain aspects of the present techniques.

FIG. 2 is an exemplary modeling system 200 in accordance with certain aspects of the present techniques. In this modeling system 200, a first device 202 and a second device 203 may be coupled to various client devices 204, 206 and 208 via a network 210. The first device 202 and second device 203 may be a computer, server, database or other processor-based device, while the other devices 204, 206, 208 may be laptop computers, desktop computers, servers, or other processor-based devices. Each of these devices 202, 203, 204, 206 and 208 may include a monitor, keyboard, mouse and other user interfaces for interacting with a user.

Because each of the devices 202, 203, 204, 206 and 208 may be located in different geographic locations, such as different offices, buildings, cities, or countries, the network 210 may include different devices (not shown), such as routers, switches, bridges, for example. Also, the network 210 may include one or more local area networks, wide area networks, server area networks, or metropolitan area networks, or combination of these different types of networks. The connectivity and use of network 210 by the devices 202, 203, 204, 206 and 208 may be understood by those skilled in the art.

The first device 202 includes a user tool 212 that is configured to provide different well operability limits and well producibility limits based on response surfaces 214 to a user of the devices 202, 204, 206 and/or 208. The user tool 212, which may reside in memory (not shown) within the first device 202, may be an application, for example. This application, which is further described below, may provide computer-based representations of a well completion, such as well 103 of FIG. 1, connected to a petroleum reservoir or a depositional basin, such as subsurface formation 108 of FIG. 1. The user tool 212 may be implemented as a spreadsheet, program, routine, software package, or additional computer readable software instructions in an existing program, which may be written in a computer programming language, such as Visual Basic, Fortran, C++, Java and the like. Of course, the memory storing the user tool 212 may be of any conventional type of computer readable storage device used for storing applications, which may include hard disk drives, floppy disks, CD-ROMs and other optical media, magnetic tape, and the like.

As part of the user tool 212, various engineering models, which are based on complex, coupled-physics models, may be utilized to generate response surfaces for various failure modes. The response surfaces 214 may include various algorithms and equations that define the technical limits for the well for various failure modes. Further, the user tool 212 may access previously generated response surfaces, which may be applied to other wells. That is, the user tool 212 may be based on a common platform to enable users to evaluate technical limits at the same time, possibly even simultaneously. Further, the user tool 212 may be configured to provide graphical outputs that define the technical limit and allow the user to compare various parameters to modify technical limits to enhance the production rates without damaging the well. These graphical outputs may be provided in the form of graphics or charts that may be utilized to determine certain limitations or enhanced production capacity for a well. In particular, these technical limits may include the well operability limits, well producibility limits and coupled physics limits, which as each discussed below in greater detail.

The second device 203 includes a coupled physics tool 218 that is configured to integrate various engineering models together for a well completion. The coupled physics tool 218, which may reside in memory (not shown) within the second device 203, may be an application, for example. This application, which is further described below in FIGS. 7 and 8, may provide computer-based representations of a well completion, such as well 103 of FIG. 1, connected to a petroleum reservoir or a depositional basin, such as subsurface formation 108 of FIG. 1. The coupled physics tool 218 may be implemented as a program, routine, software package, or additional computer readable software instructions in an existing program, which may be written in a computer programming language, such as Visual Basic, Fortran, C++, Java and the like. Of course, the memory storing the coupled physics tool 218 may be of any conventional type of computer readable storage device used for storing applications, which may include hard disk drives, floppy disks, CD-ROMs and other optical media, magnetic tape, and the like.

Associated with the coupled physics tool 218, various engineering models, which are based on complex, coupled-physics models, may be utilized to generate coupled physics technical limits 220 for various failure modes. The coupled physics technical limits 220 may include various algorithms and equations that define the technical limits for the well for various failure modes that are based on the physics for the well completion and near well completion. Similar to the user tool 212, the coupled physics technical limits 220 may be accessed by other devices, such as devices 202, 204, 206 and 208, and may be configured to provide graphical outputs that define the technical limit. A more detailed discussion of the coupled physics limits or coupled physics technical limits is discussed in FIGS. 7 and 8 below.

Beneficially, under the present technique, the operation of the well may be enhanced by technical limits derived from utilizing the user tool 212 which is based on response surfaces 214 developed using engineering simulation models or computational simulation models based on either finite difference, 3D geomechanical finite-element, finite element, finite volume, or another point or grid/cell based numerical discretization method used to solve partial differential equations. Unlike the complicated engineering models, the user tool 212 is based on response surfaces 214 that are derived from the use of engineering models not designed for a specific application or development opportunity. The user tool 212 based on response surfaces 214 may be utilized for a variety of different wells. That is, the response surfaces 214 may represent detailed engineering models without requiring tremendous amount of computing power and skilled expertise to operate, configure, and evaluate the software packages, such as, but not limited to, ABAQUS™ Fluent™, Excel™, and Matlab™. Also, in contrast to the simplified models, the technical limits developed using the user tool 212 accounts for the physics governing well performance. That is, the user tool 212 accounts for various physical parameters, which are ignored by analysis's based solely on simplified models, such as rates, hog's laws, and/or rules-of-thumb, for example.

Furthermore, because detailed engineering models have been simplified to response surfaces 214, the user tool 212 may be applied to a variety of wells to assess the risk of mechanical well integrity or operability failure, potential for well producibility or flow capacity limit, optimize well performance using the well operability limits along with the well producibility limits, and/or the coupled physics technical limit that addresses other physical phenomenon not addressed by the operability and producibility limits, as discussed below. As an example, a risk assessment may be conducted during the concept selection phase to aid in well completion selection decisions, well planning phase to aid in well and completion designs, and production phase to prevent failures and increase the production rates based on the technical limits. That is, the response surfaces 214 of the user tool 212 may be applied to various phases of the well's development because the user may adjust a wide range of input parameters for a given well without the time and expense of engineering models or the errors associated with limiting assumptions within simplified models. Accordingly, the user tool 212 may be utilized to provide well technical limits relating to well operability, as discussed in association with FIGS. 3-4, well producibility limits, as discussed in association with FIGS. 5-6. Further, the user tool 212 derived well operability limits and/or well producibility limits and/or coupled physics limits, as discussed in association with FIGS. 7-8, may be employed in the optimization of various technical limits or well operating parameters, as discussed in association with FIGS. 9-10.

As one embodiment, the user tool 212 may be utilized to provide response surfaces 214 that are directed to determining the well operability limits. The well operability limits relate to the mechanical integrity limits of a well before a mechanical failure event occurs. The mechanical failure may be an event that renders the well unusable for its intended purpose. For example, the mechanical failure of the well 103 of FIG. 1 may result from compaction, erosion, sand production, collapse, buckling, parting, shearing, bending, leaking, or other similar mechanical problems during production or injection operations of a well. Typically, these mechanical failures result in costly workovers, sidetracking of the well or redrilling operations utilized to capture the hydrocarbon reserves in the subsurface formation 108 of FIG. 1. These post failure solutions are costly and time-consuming methods that reactively address the mechanical failure. However, with the user tool 212, potential mechanical well failure issues may be identified during the different phases to not only prevent failures, but operate the well in an efficient manner within its technical limit.

Figure 3:
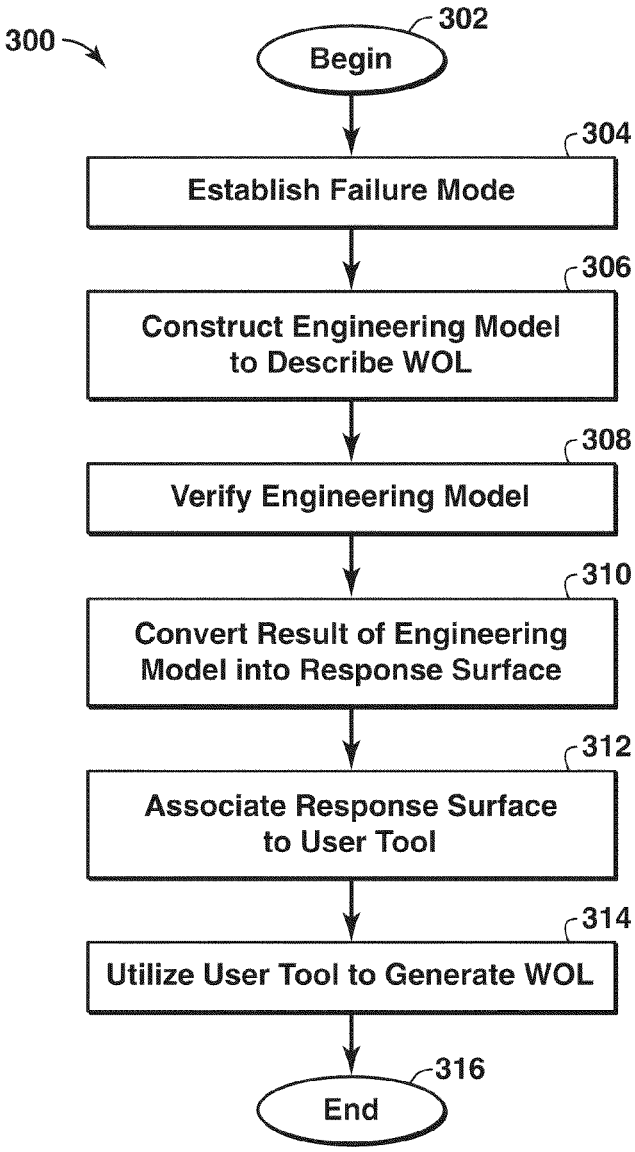
FIG. 3 is an exemplary flow chart of the development of response surfaces for well operability limits in accordance with aspects of the present techniques.

FIG. 3 is an exemplary flow chart of the generation and use well operability limits with the user tool 212 of FIG. 2 in accordance with aspects of the present techniques. This flow chart, which is referred to by reference numeral 300, may be best understood by concurrently viewing FIGS. 1 and 2. In this flow chart 300, response surfaces 214 may be developed and utilized to provide completion limits and guidelines for the conception selection, well planning, economic analysis, completion design, and/or well production phases of the well 103. That is, the present technique may provide response surfaces 214 for various mechanical or integrity failure modes from detailed simulations performed and stored on an application, such as the user tool 212, in an efficient manner. Accordingly, the response surfaces 214, which are based on the coupled-physics, engineering model, provide other users with algorithms and equations that may be utilized to solve mechanical well integrity problems more efficiently.

The flow chart begins at block 302. At block 304, the failure mode is established. The establishment of the failure mode, which is the mechanical failure of the well, includes determining how a specific well is going to fail. For example, a failure mode may be sand production that results from shear failure or tensile failure of the rock. This failure event may result in a loss of production for the well 103.

At block 306, an engineering model for a failure mode is constructed to model the interaction of the well construction components. These components include pipe, fluid, rocks, cement, screens, and gravel under common producing conditions, flowing bottom hole pressure (FBHP), drawdown, depletion, rate, water-oil ratio (WOR), gas-oil ratio (GOR), or the like. The failure criteria are identified based on well characteristics, which may relate to a specific failure event for the well. As an example, with the failure mode being sand production, the engineering model may utilize the rock mechanical properties with a numerical simulation model of the reservoir and well to predict when sand production occurs under various production conditions, which may include production rate, drawdown, and/or depletion. The engineering models are then verified to establish that the engineering models are valid, as shown in block 308. The verification of the engineering models may include comparing the results of the engineering models with actual data from the well 103, comparing the results of the response surface to the results of the engineering models, or comparing the engineering models to other wells within the field to establish that the simplifying assumptions are valid.

Because the engineering models are generally detailed finite element models that take a significant amount of time to evaluate, such as one or more hours to multiple days, the engineering model is converted into one or more algorithms or equations that are referred to as the response surfaces 214, as shown in block 310. The conversion includes performing a parametric study on a range of probable parameters with the engineering model to create the different response surfaces 214. The parametric study may utilize a numerical design of experiments to provide the algorithms for various situations. Beneficially, the parametric study captures the various physical parameters and properties that are not accounted for with analytical models that are typically utilized in place of numerical models. The results of the parametric study are reduced to simple equations through fitting techniques or statistical software packages to form the response surfaces 214. These curve and surface fitting techniques define generalized equations or algorithms, which may be based on engineering judgement and/or analytical simplifications of the engineering models. Specifically, a trial and error approach may be utilized to define a reasonable form of the response surfaces 214 that may be fit to the large number of results from the parametric study. Accordingly, the response surfaces 214 may be further simplified by using various assumptions, such as homogeneous rock properties in a reservoir zone, linear well paths through the production intervals, and/or disc-shaped reservoir, for example.

At block 312, the algorithms and equations that define the response surfaces 214 are included in the user tool 212. As noted above, the user tool 212 may be utilized to provide graphical outputs of the technical limit for users. These graphical outputs may compare production or injection information, such as rate and pressures. In this manner, the user, such as an operator or engineer, may evaluate current production or injection rates versus the technical limit indicated from the response surfaces 214 to adjust the certain parameters to prevent well failure or improve the performance of the well 103. This evaluation may be performed in a simplified manner because the previously generated response surfaces may be accessed instead of having to utilize the engineering models to simulate the respective conditions for the well. As such, a user may apply a quantitative risk analysis to the technical limit generated by the response surfaces 214 to account for the uncertainty of input parameters and manage the associated risk. At block 314, the user tool 212 may be utilized to efficiently apply the previously generated response surfaces 214 to economic decisions, well planning, well concept selection, and well operations phases. Accordingly, the process ends at block 316.

As a specific example, the well 103 may be a cased-hole completion that includes various perforations 126. In this type of completion, changes in the pore pressure at the sand face of the subsurface formation 108, which may be based upon the reservoir drawdown and depletion, may increase the stress on the perforations 126 in the rock of the production interval or zone 116. If the effective stresses on the rock in the production zone 116 exceed the shear failure envelope or rock failure criterion, then sand may be produced through the perforations 126 into the wellbore 114. This production of sand into the wellbore 114 may damage equipment, such as the tree 104 and valves 128 and 130, and facilities, such as the production facility 102. Accordingly, the shear failure of the rock in the subsurface formation 108 or crossing the rock failure criterion in the engineering model may be identified as the failure mode, as discussed in block 304.

Once the failure mode is identified, the engineering model may be constructed to describe the mechanical well operability limits (WOL), as discussed in block 306. The engineering model construction may include defining finite element models to simulate well drainage from the production zone 116 through perforations 126 into the wellbore 114. These three dimensional (3-D) models may include parameters that represent the reservoir rock in the production interval 116, cement lining 125, and production casing string 124. For instance, the perforations 126 in the production casing string 124 may be modeled as cylindrical holes, and the perforations 126 in the cement lining 125 and reservoir rock may be modeled as truncated cones with a half-sphere at the perforation tip.

Further, properties and parameters may also be assigned to the reservoir rock, cement lining 125, and production casing string 124. For example, symmetry in the model is based on perforation phasing and shot density. Also, boundary conditions are applied to represent reservoir pressure conditions. Then, each model is evaluated at various levels of drawdown to determine the point at which the rock at the perforations 126 exceeds the shear failure envelope or rock failure criterion. Drawdown is modeled as radial Darcy flow from the well drainage radius to the perforations 126. The well drainage area is the area of the subsurface formation 108 that provides fluids to the wellbore 114.

As an example, one or more finite element models may be created by varying the certain parameters. These parameters may include: (1) rock properties (rock unconfined compressive strength (USC), rock friction angle (RFA); elastic or shear modulus, and/or rock Poisson's ratio (RPR), (2) casing properties, such as pipe grades (e.g. L80, P110, T95, Q125); (3) cement properties unconfined compressive strength (UCS), friction angle, elastic or shear modulus, Poisson's ratio); (4) well drainage radius (WDR); (5) perforation geometry (PG) (perforations entrance diameter (PED), perforations length (PL), and perforations taper angle (PTA); (6) casing size (casing outer diameter (COD) and casing diameter/thickness (D/T) ratio (CDTR); (7) cemented annulus size; (8) perforation phasing; and (9) perforation shots per foot (PSPF). While each of these parameters may be utilized, it may be beneficial to simplify, eliminate, or combine parameters to facilitate the parametric study. This reduction of parameters may be based upon engineering expertise to combine experiments or utilizing an experimental design approach or process to simply the parametric study. The automation scripts may be used to facilitate model construction, simulation, and simulation data collection to further simplify the parametric study. For this example, casing properties, perforation phasing, and perforation shots per foot are determined to have a minimal impact and are removed from the parametric study. Accordingly, the parametric study may be conducted on the remaining parameters, which are included in the Table 1 below.

TABLE 1

WOL Parametric Study.

| Model # | RC | RFA | RPR | WDR | PED | PL | PTA | COD | CDTR |
|---|---|---|---|---|---|---|---|---|---|
| 1 | 1 | 1 | 1 | 1 | 1 | 1 | 1 | 1 | 1 |
| 2 | 1 | 2 | 1 | 3 | 2 | 1 | 3 | 2 | 2 |
| 3 | 3 | 2 | 2 | 3 | 1 | 1 | 1 | 3 | 1 |
| 4 | 2 | 3 | 2 | 2 | 1 | 3 | 1 | 3 | 2 |

In this example, three values may be defined for each of the nine parameters listed above. As a result, 19683 possible combinations or models may have to be evaluated as part of the parametric study. Each of the models may be evaluated at multiple values of drawdown to develop the individual technical limit states for each model (e.g. drawdown versus depletion).

With the engineering models created, the engineering models may be verified and converted into response surfaces 214. The verification of the engineering models, as discussed in block 308, may involve comparing the individual engineering model results with actual field data to ensure that the estimates are sufficiently accurate. The actual field data may include sand production at a specific drawdown for the completion. Then, the engineering models may be converted into the response surface, which is discussed above in block 310. In particular, the results and respective parameters for the different engineering models may be compiled in a spreadsheet or statistical evaluation software. The effects of changing the nine parameters individually and interactively are evaluated to develop the response surfaces 214 for the engineering models. The resulting response surface equation or equations provide a technical limit or well operability limit, as a function of drawdown.

If the user tool 212 is a computer program that includes a spreadsheet, the response surfaces 214 and the associated parameters may be stored within a separate file that is accessible by the program or combined with other response surfaces 214 and parameters in a large database. Regardless, the response surfaces and parameters may be accessed by other users via a network, as discussed above. For instance, the user tool 212 may accept user entries from a keyboard to describe the specific parameters in another well. The response surfaces 214, which are embedded in the user tool 212, may calculate the well operability limits from the various entries provided by the user. The entries are preferably in the range of values studied in the parametric study of the engineering model.

Figure 4:
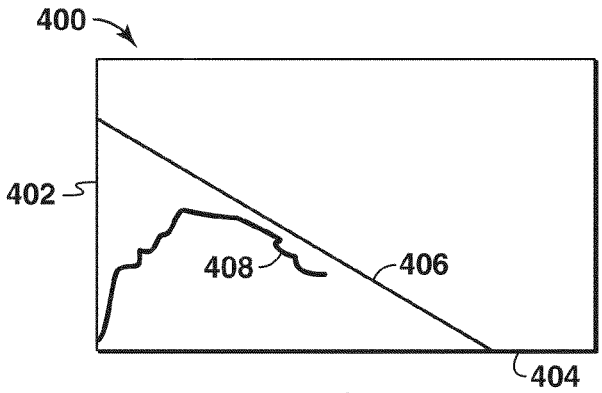
FIG. 4 is an exemplary chart of well drawdown versus well drainage area depletion of the well in FIG. 1 in accordance with the present techniques.

As result of this process, FIG. 4 illustrates an exemplary chart of the drawdown verses the depletion of a well in accordance with the present techniques. In FIG. 4, a chart, which is generally referred to as reference numeral 400, compares the drawdown 402 of a well to the depletion 404 of the well 103. In this example, the response surfaces 214 may define a technical limit 406, which is well operability limit, generated from the user tool 212. As shown in the chart 400, the technical limit 406 may vary based on the relative values of the drawdown 402 and the depletion 404. The well 103 remains productive or in a non-failure mode as long as the production or injection level 408 is below the technical limit 406. If the production or injection level 408 is above the technical limit 406, then a shear failure of the rock in the subsurface formation 108 is likely to occur. That is, above the technical limit 406, the well 103 may become inoperable or produce sand. Accordingly, the response surface may be utilized to manage reservoir drawdown and depletion based on a technical limit indicated from the response surface.

Beneficially, under the present technique, the different developmental phases of the well 103 may be enhanced by utilizing the user tool 212 to determine the well operability limits and to maintain the well 103 within those limits. That is, the user tool 212 provides users with previously generated response surfaces 214 during each of the development phases of the well 103. Because the response surfaces 214 have been evaluated versus parameters and properties, the user tool 212 provides accurate information for the mechanical integrity or well operability limits without the delays associated with complex models and errors present in simplistic models. Further, the user tool 212 may provide guidelines for operating the well 103 to prevent failure events and enhance production up to well operability limits.

As another benefit, the response surface may be utilized to generate a well injectibility limit. The well injectibility limit defines the technical limit for an injection well in terms of the well's ability to inject a specified rate of fluids or fluids and solids within a specific zone of a subsurface formation. An example of a failure mode that may be addressed by the injectibility limit is the potential for injection related fracture propagating out of the zone and thereby resulting in loss of conformance. Another example of failure mode that can be addressed is the potential for shearing of well casing or tubulars during multi-well interactions resulting from injection operations in closed spaced well developments. The well injectibility limit response surface may also be utilized as a well inflow performance model in a reservoir simulator to simulate injection wells or within standalone well or a well completions simulator to simulate well performance.

Similarly, to the discussion of mechanical failures, impairments to the flow capacity and characteristics of a well influence production or injection rates from the well. The impairments may be due to perforation geometry and/or high velocity (i.e., non-Darcy) flow, near-wellbore rock damage, compaction-induced perm loss, or other similar effects. Because models that describe the impairments are oversimplified, the well productivity or injectivity analysis that is provided by these models neglect certain parameters and provide inaccurate results. Consequently, errors in the prediction and/or assessment of well productivity or injectivity from other models may adversely impact evaluation of field economics. For example, failure to accurately account for the effects of completion geometry, producing conditions, geomechanical effects, and changes in fluid composition may result in estimation errors for production rates. During the subsequent production phase, the estimate errors may result in misinterpretations of well test data, which may lead to costly and potentially ineffective workovers in attempts to stimulate production. In addition to the errors with simple models, complex models fail because these models are solely directed to a particular situation. As a result, various wells are insufficiently evaluated or ignored because no tools exist to provide response surfaces for these wells in a comprehensive, yet efficient manner.

Under the present technique, the producibility or injectibility of the well may be enhanced by utilizing the data, such as response surfaces in the user tool. As discussed above, these response surfaces may be simplified engineering models based on engineering computational models, such as 3D geomechanical finite element model. This enables different users to access the previously generated response surfaces for the analysis of different wells in various phases, such as conception selection, well planning, economic analysis, completion design and/or well production phases. During well surveillance, for example, impairment is often interpreted from measured "skin" values. Yet, the skin values are not a valid indication of a well's actual performance relative to its technical limit. Accordingly, by converting the engineering models into response surfaces, as discussed above, other parameters may be utilized to provide the user with graphs and data that are more valid indications of the technical limit of the well. This enhances the efficiency of the analysis for the user and may even be utilized in each phase of well development. The exemplary flow chart of this process for use in determining the well producibility limit is provided in FIG. 5.

Figure 5:
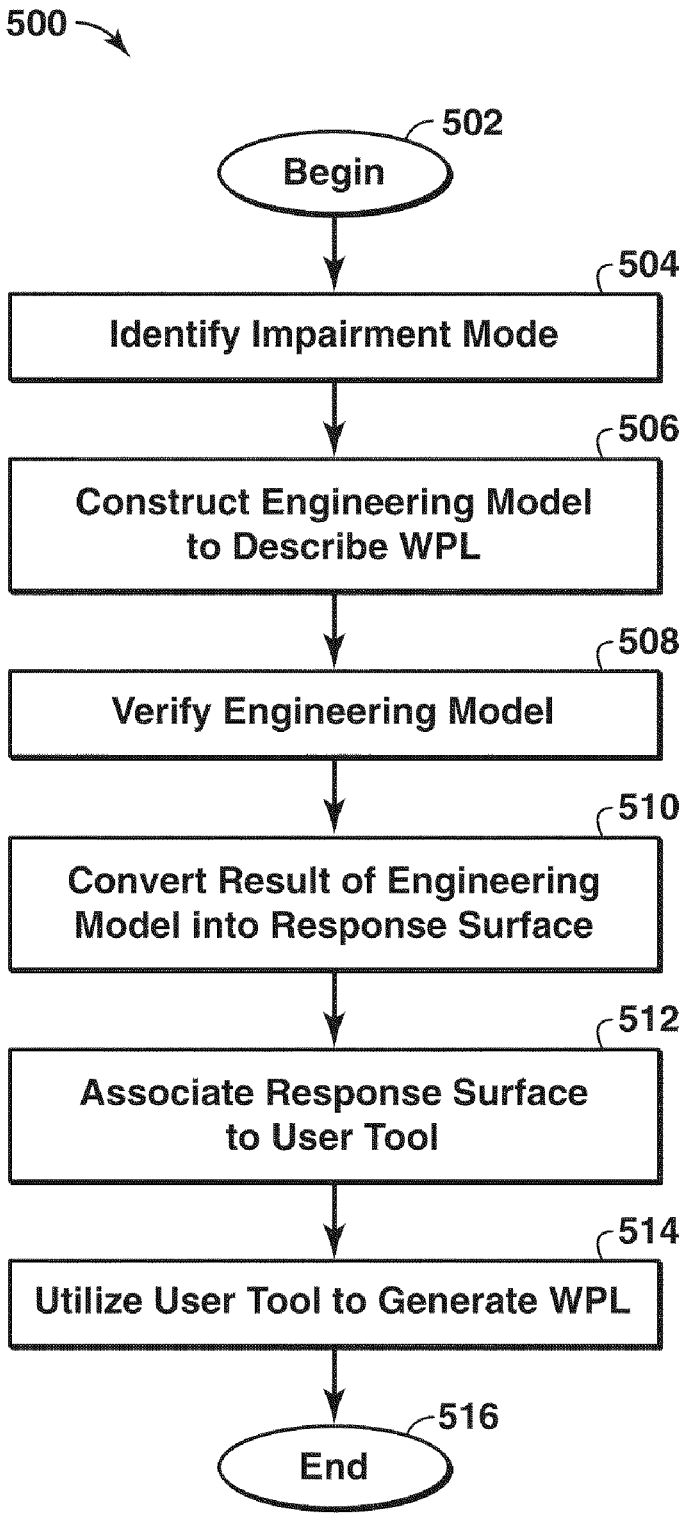
FIG. 5 is an exemplary flow chart of the development of response surfaces for well producibility limits in accordance with aspects of the present techniques.

As shown in FIG. 5, an exemplary flow chart relating to the use of well producibility limits in the user tool 212 of FIG. 2 in accordance with aspects of the present techniques is shown. This flow chart, which is referred to by reference numeral 500, may be best understood by concurrently viewing FIGS. 1, 2 and 3. In this embodiment, response surfaces associated with the flow capacity and characteristics may be developed and utilized to provide technical limits and guidelines for the concept selection, well planning, economic analysis, completion design, and/or well production phases. That is, the user tool 212 may provide response surfaces 214 for various well producibility limits based upon detailed simulations previously performed for another well in an efficient manner.

The flow chart begins at block 502. At block 504, the impairment mode is identified for the well 103. The identification of the impairment mode includes determining conditions that hinder the flow capacity of fluids to and within the well 103 or injection capacity of fluids and/or solids from well 103 into the formation 108. As noted above, impairments are physical mechanisms governing near-wellbore flow or are a failure of the well 103 to flow or inject at its theoretical production or injection rate, respectively. For example, the impairment mode may include perforations acting as flow chokes within the well 103.

At block 506, an engineering model for the impairment mode is constructed to model the interaction of well characteristics. These characteristics include well and completion components, pipe, fluid, rocks, screens, perforations, and gravel under common producing conditions, flowing bottom hole pressure (FBHP), drawdown, depletion, rate, water/oil ratio (WOR), gas/oil ratio (GOR), or the like. As an example, with the impairment being perforations acting as a flow choke, the engineering model may utilize rock and fluid properties with a numerical simulation model of the reservoir, well, and perforations to predict the amount of impairment under various production conditions, such as rate, drawdown, and/or depletion. Then, the engineering models are verified, as shown in block 508. The verification of the engineering models may be similar to the verification discussed in block 308.

Because the engineering models are generally detailed finite element models, as discussed above in block 306, the engineering model is converted into response surfaces 214 that include one or more algorithms or equations, as shown in block 510. Similar to the discussion above regarding block 310, parametric studies are performed to provide the response surfaces from various parameters and properties. Beneficially, the parametric studies capture aspects not accounted for with analytical models normally utilized to replace numerical models. Again, these results from the parametric studies are reduced to numerical equations through fitting techniques or statistical software packages to form the response surfaces 214.

At block 512, the algorithms of the response surfaces 214 are included in a user tool 212. As noted above in block 312, the user tool 212 may be utilized to provide graphical outputs of the technical limit for the well producibility limits to the users. In this manner, the user may evaluate current production or injection versus the technical limit to adjust the rate or determine the impairments of the well. At block 514, the response surfaces 214 may be utilized to efficiently apply previously generated response surfaces 214 to economic decisions, well planning, well concept selection, and/or well production phases. Accordingly, the process ends at block 516.

As a specific example, the well 103 may be a cased-hole completion that includes various perforations 126. In this type of completion, the flow of fluids into the wellbore 114 may be impaired because of the "choke" effect of the perforations 126. If the impairment is severe enough, the well may fail to achieve target rates with the associated drawdown. In this sense, impairment may be synonymous with failure. In such situations, the lower production rates may be accepted, but these lower production rates adversely impact the field economics. Alternatively, the drawdown pressure of the well 103 may be increased to restore the well 103 to the target production rate. However, this approach may not be feasible because of pressure limitations at the production facility 102, drawdown limits for well operability, and other associated limitations. Accordingly, the pressure drop into and through the perforations 126 of the well completion may be identified as the impairment or failure mode for the well 103, as discussed above in block 504.

Once the impairment mode is identified, the engineering model may be constructed to describe the well producibility limit (WPL), as discussed in block 506. The engineering model construction for well producibility limits may include defining engineering computational models such as finite element models, to simulate convergent flow into the wellbore through perforations 126 in the well 103. Similar to the engineering model construction of the well operability limits discussed above, the engineering models may include the parameters that represent the reservoir rock in the production interval 116, cement lining 125, and production casing string 124.

Further, properties or parameters may again be assigned to the reservoir rock, cement lining 125, and production casing string 124. For example, each engineering model is evaluated at various levels of drawdown to determine the drawdown at which the impairment exceeds a threshold that prevents target production rates from being achieved. From this, multiple finite element models are created for a parametric study by varying the following parameters: (1) rock permeability; (2) perforation phasing; (3) perforation shot density; (4) perforation length; (5) perforation diameter; (6) well drainage radius; and (7) wellbore diameter. This example may be simplified by removing the drainage radius and wellbore diameter parameters, which are believed to have a minimal impact on the results of the parametric study. Accordingly, the parametric study is conducted on the remaining parameters, which are included in the Table 2 below.

TABLE 2

WPL Parametric Study.

| Model Number | Rock Permeability | Perforation Phasing | Shot Density | Perforation Length | Perforation Diameter |
|---|---|---|---|---|---|
| 1 | 1 | 1 | 1 | 1 | 1 |
| 2 | 1 | 2 | 1 | 3 | 2 |
| 3 | 3 | 2 | 2 | 3 | 1 |
| 4 | 2 | 3 | 2 | 2 | 1 |

In this example, if three values are defined for each of the five parameters listed above, two hundred forty three possible combinations or models may have to be evaluated. Each of the models is evaluated at multiple values of drawdown to develop the individual limit states for each model (e.g. production rate vs. drawdown). Accordingly, for this example, the well producibility limit (WPL) may be defined by the failure of the well completion to produce at a specified target rate.

With the engineering models created, the engineering models may be verified and converted into response surfaces, as discussed in blocks 508 and 510 and the example above. Again, the response surfaces 214 are created from fitting techniques that generalize the equations of the engineering models. The resulting equation or equations provides the limit state or well producibility limit, which may be stored in the user tool 212, as discussed above.

Figure 6B:
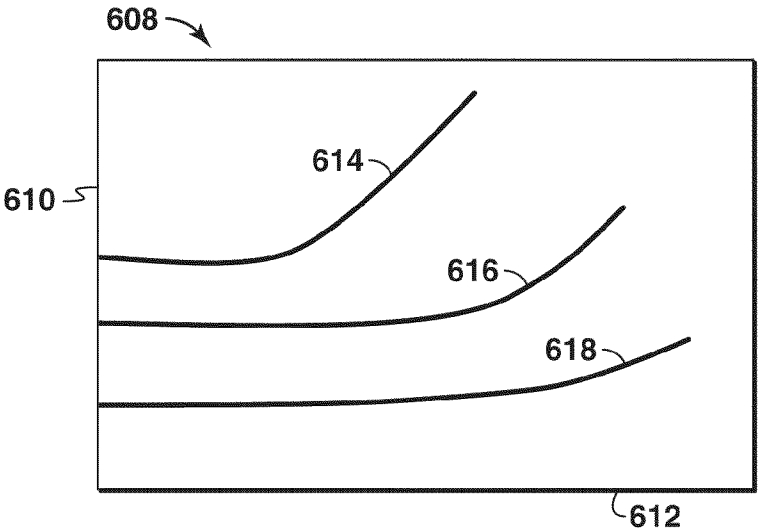
FIGS. 6A and 6B are exemplary charts of well producibility limit of the well in FIG. 1 in accordance with the present techniques.
Figure 6A:
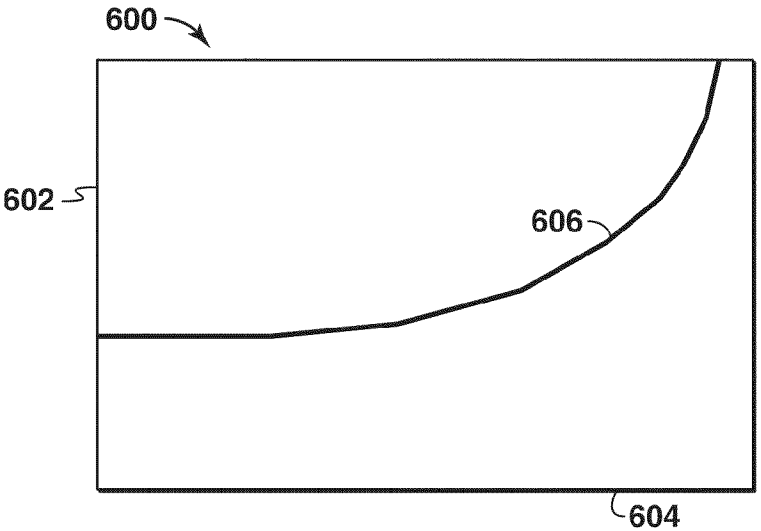

As result of this process, FIGS. 6A and 6B illustrate exemplary charts of the well producibility limit in accordance with the present techniques. In FIG. 6A, a chart, which is generally referred to as reference numeral 600, compares the measure of impairment 602 to the drawdown 604 of the well 103. In this example, the response surfaces 214 may define a technical limit 606, which is the well producibility limit, generated from the user tool 212. As shown in the chart 600, the technical limit 606 may vary based on the relative values of the impairment 602 and the drawdown 604. The well 103 remains productive or in non-impairment mode as long as the measured impairment is below the technical limit 606. If the measured impairment is above the technical limit 606, then the "choke" effect of the perforations 126 or other impairment modes may limit production rates. That is, above the technical limit 606, the well 103 may produce less than a target rate and remedial actions may be performed to address the impairment.

In FIG. 6B, a chart, which is generally referred to as reference numeral 608, compares the drawdown 610 with depletion 612 of the well 103. In this example, the technical limit 606 may be set to various values for different well profiles 614, 616 and 618. A well profile may include the completion geometry, reservoir and rock characteristics, fluid properties, and producing conditions, for example. As shown in the chart 608, the well profiles 614 may be perforations packed with gravel, while the well profile 616 may be natural perforations without gravel. Also, the well profile 618 may include fracture stimulation. The well profiles 614, 616 and 618 illustrate the specific "choke" effects of the perforations 126 or other impairment modes based on different geometries, or other characteristics of the well.

Beneficially, as noted above, users from any location may access the user tool 212 to create the well producibility limit and determine the amount of impairment expected for particular parameters, such as the perforation design, rock characteristics, fluid properties, and/or producing conditions of a well. The user tool 212 may be efficient mechanism because it accesses previously determined response surfaces 214 and provides them during various phases or stages of a well's development. For example, during the concept selection and well planning phase, the user tool 212 may be utilized to review expected performance rates of a variety of well completion designs. Similarly, during the design phase, the user tool 212 may enhance or optimize specific aspects of the well design. Finally, during the production phase, the user tool 212 may be utilized to compare observed impairments with expected impairments to monitor the performance of the well completion.

As a third embodiment of the present techniques, the user tool 212 of FIG. 2 may be utilized to predict, optimize, and evaluate the performance of the well 103 based on engineering models that are associated with physics describing flow into or out of the well. As noted above, the well 103, which may operate in a production or injection mode, may be utilized to produce various fluids, such as oil, gas, water, or steam. Generally, engineering modeling techniques do not account for the complete set of first principle physics governing fluid flows into or out of the wellbore and within a well completion. As a result, engineering models typically employ analytical solutions based on highly simplifying assumptions, such as the wide spread use of superposition principles and linearized constitutive models for describing physics governing well performance. In particular, these simplifying assumptions may include single phase fluid flow theories, application of simple superposition principles, treating the finite length of the well completion as a "point sink," single phase pressure diffusion theories in the analysis of well pressure transient data, and use of a single "scalar" parameter to capture the wellbore and near-well pressure drops associated with flows in the wellbore, completion, and near-wellbore regions. Also, as previously discussed, the engineering models may rely upon hog laws and non-physical free parameters to attempt to cure the deficiencies arising from these simplifications. Finally, the simplified versions of the engineering models fail to assist in diagnosing the problems with a well because the diagnostic data obtained from the engineering models is often non-unique and does not serve its intended purpose of identifying the individual root cause problems that affect well performance. Thus, the engineering models fail to account for the coupling and scaling of various physical phenomenons that concurrently affect well performance.

To compound the problems with the simplified assumptions, engineering models are generally based on a specific area of the well and managed in a sequential manner. That is, engineering models are designed for a specific aspect of the operation of a well, such as well design, well performance analysis, and reservoir simulators. By focusing on a specific aspect, the engineering models again do not consistently account for the various physical phenomena that concurrently influence well performance. For example, completion engineers design the well, production engineers analyze the well, and reservoir engineers simulate well production within their respective isolated frameworks. As a result, each of the engineering models for these different groups consider the other areas as isolated events and limit the physical interactions that govern the operations and flow of fluids into the well. The sequential nature of the design, evaluation, and modeling of a well by the individuals focused on a single aspect does not lend itself to a technique that integrates a physics based approach to solve the problem of well performance.

Accordingly, under the present technique, coupled physics tool 218 of FIG. 2 may be configured to provide a coupled physics limits for a well. The coupled physics limits, which are technical limits, may be utilized in various phases of the well, which are discussed above. This coupled physics limits may include effects of various parameters or factors; such as reservoir rock geology and heterogeneity, rock flow and geomechanical properties, surface facility constraints, well operating conditions, well completion type, coupled physical phenomenon, phase segregation, rock compaction related permeability reduction and deformation of wellbore tubulars, high-rate flow effects, scale precipitation, rock fracturing, sand production, and/or other similar problems. Because each of these factors influences the flow of fluids from the subsurface reservoir rock into and through the well completion for a producing well or through the well completion into the subsurface formation for an injection well, the integration of the physics provides an enhanced well performance modeling tool, which is discussed in greater detail in FIG. 7.

Figure 7:
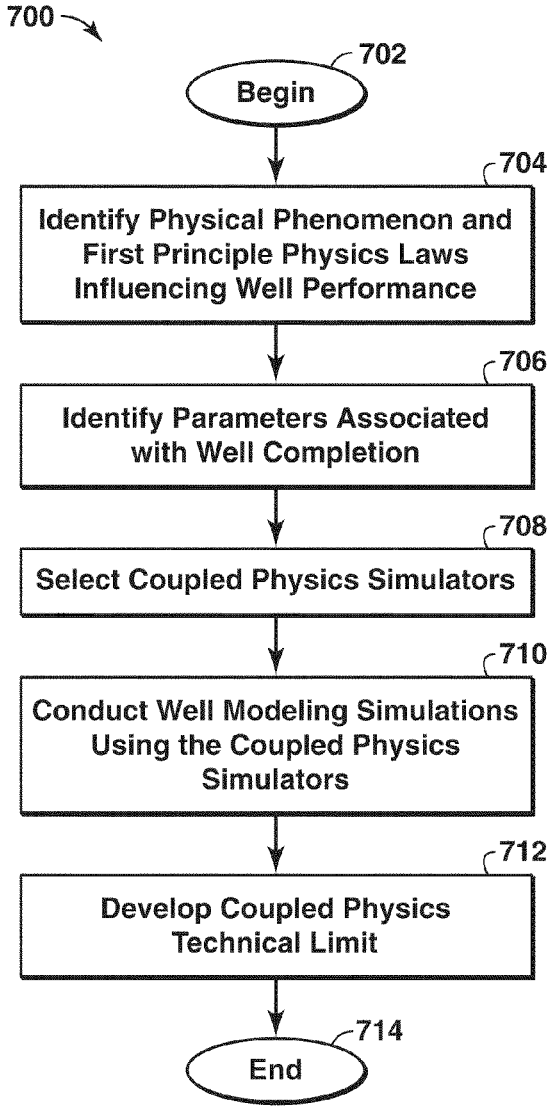
FIG. 7 is an exemplary flow chart of the development of coupled physics limits in accordance with aspects of the present techniques.

FIG. 7 is an exemplary flow chart of the development of a coupled physics limit in accordance with aspects of the present techniques. In this flow chart, which is referred to by reference numeral 700, a coupled physics technical limit or coupled physics limit may be developed and utilized to quantify expected well performance in the planning stage, design and evaluate various well completion types to achieve desired well performance during field development stage, perform hypothetical studies and Quantitative Risk Analysis (QRA) to quantify uncertainties in expected well performance, identify root issues for under performance of well in everyday field surveillance and/or optimize individual well operations. That is, the present technique may provide technical limit(s), which are a set of algorithms for various well performance limits based on generalized coupled physics models generated from detailed simulations performed for this well or another. These simulations may be performed by an application, such as the user tool 212 or coupled physics tool 218 of FIG. 2.

The flow chart begins at block 702. In blocks 704 and 706, the various parameters and first principle physical laws are identified for a specific well. At block 704, the physical phenomenon and first principle physical laws influencing well performance are identified. The first principle physical laws governing well performance include, but are not limited to, fluid mechanics principles that govern multi-phase fluid flow and pressure drops through reservoir rocks and well completions, geomechanics principles that govern deformation of near-wellbore rock and accompanying well tubular deformations and rock flow property changes, thermal mechanics that are associated with the phenomenon of heat conduction and convection within near-well reservoir rock and well completion, and/or chemistry that governs the phenomenon behind non-native reservoir fluids (i.e. acids, steam, etc.) reacting with reservoir rock formations, formation of scales and precipitates, for example. Then, the parameters associated with the well completion, reservoir geology (flow and geomechanical) and fluid (reservoir and non native reservoir) properties are also identified, as shown in block 706. These parameters may include the various parameters, which are discussed above.

With the physical laws and parameters identified, the coupled physics limit may be developed as shown in blocks 708-714. At block 708, a set of coupled physics simulators may be selected for determining the well performance. The coupled physics simulators may include engineering simulation computer programs that simulate rock fluid flow, rock mechanical deformations, reaction kinetics between non-native fluids and reservoir rock and fluids, rock fracturing, etc. Then, well modeling simulations using the coupled physics simulators may be conducted over a range of well operating conditions, such as drawdown and depletion, well stimulation operations, and parameters identified in block 706. The results from these simulations may be used to characterize the performance of the well, as shown in block 710. At block 712, a coupled physics limit, which is based on the well modeling simulations, may be developed as a function of the desired well operating conditions and the parameters. The coupled physics limit is a technical limit that incorporates the complex and coupled physical phenomenon that affects performance of the well. This coupled physical limit includes a combination of well operating conditions for maintaining a given level of production or injection rate for the well. Accordingly, the process ends at block 714.

Beneficially, the coupled physics limit may be utilized to enhance the performance of the well in an efficient manner. For instance, integrated well modeling based on the coupled physics simulation provides reliable predictions, evaluations, and/or optimizations of well performance that are useful in design, evaluation, and characterization of the well. The coupled physics limits provide physics based technical limits that model the well for injection and/or production. For instance, the coupled physics limits are useful in designing well completions, stimulation operations, evaluating well performance based on pressure transient analysis or downhole temperature analysis, combined pressure and temperature data analysis, and/or simulating wells inflow capacity in reservoir simulators using inflow performance models. As a result, the use of coupled physics limits eliminates the errors generated from non-physical free parameters when evaluating or simulating well performance. Finally, the present technique provides reliable coupled physics limits for evaluating well performance, or developing a unique set of diagnostic data to identify root cause problems affecting well performance.

As a specific example, the well 103 may be a fracture gravel packed well completion that is employed in deepwater GOM fields having reservoirs in sandstone and characterized by weak shear strengths and high compressibility. These rock geomechanical characteristics of the sandstone may cause reservoir rock compaction and an accompanying loss in well flow capacities based on the compaction related reduction in permeability of the sandstone. As such, the physical phenomenon governing the fluid flow into the fracture gravel packed well completion may include rock compaction, non-Darcy flow conditions, pressure drops in the near-well region associated with gravel sand in the perforations and fracture wings.

Because each of these physical phenomena may occur simultaneously in a coupled manner within the near-well region and the well completion, a Finite Element Analysis (FEA) based physical system simulator may be utilized to simulate in a coupled manner the flow of fluids flowing through a compacting porous medium into the fractured gravel packed well completion. The rock compaction in this coupled FEA simulator may be modeled using common rock constitutive behaviors, such as elastic, plastic (i.e., Mohr-Coulomb, Drucker-Prager, Cap Plasticity. etc.) or a visco-elastic-plastic. To account for pressure drops associated with porous media flow resulting from high well flow rates, the pressure gradient is approximated by a non-Darcy pressure gradient versus the flow rate relationship. As a result, a FEA engineering model that is representative of the wellbore (i.e. the casing, tubing, gravel filled annulus, casing and cement perforations), the near-wellbore regions (perforations and fracture wings), and reservoir rock up to the drainage radius is developed. This FEA engineering model employing appropriate rock constitutive model and non-Darcy flow model for pressure drops is used to solve the coupled equations resulting from momentum balance and mass balance governing rock deformation and flow through the porous media, respectively. The boundary conditions employed in the model are the fixed flowing bottom hole pressure in the wellbore and the far-field pressure at the drainage radius. Together, these boundary conditions may be varied to simulate a series of well drawdown and depletion.

The parameters governing the performance of the well completion may be identified. For example, these parameters may include: (1) well drawdown (i.e. the difference between the far field pressure and flowing bottom hole pressure); (2) well depletion (i.e. the reduction in the far field pressure from original reservoir pressure); (3) wellbore diameter; (4) screen diameter; (5) fracture wing length; (6) fracture width; (7) perforation size in casing and cement; (8) perforation phasing; (9) gravel permeability; and/or (10) gravel non-Darcy flow coefficient. Some of these parameters, such as rock constitutive model parameters and rock flow properties, may be obtained from core testing.

In this example, the parameters (3) through (7) may be fixed at a given level within the FEA model. With these parameters fixed, the FEA model may be utilized to conduct a series of steady-state simulations for changing levels of drawdown and depletion. The results of the coupled FEA model may be used to compute well flow efficiency. In particular, if the FEA model is used to predicted flow stream for a given level of depletion and drawdown, the well flow efficiency may be defined as the ratio of coupled FEA model computed well flow rate to the ideal flow rate. In this instance, the ideal flow rate is defined as the flow into a fully-penetrating vertical well completed an openhole completion, which has the same wellbore diameter, drawdown, depletion, and rock properties as the fully coupled FEA model. The rock flow property and permeability used is the ideal flow rate calculation, which is the same as the fully coupled modeled because the rock compaction and non-Darcy flow effects are neglected. Accordingly, a series of well completion efficiencies are evaluated for varying level of drawdown and depletion and for a fixed set of parameters (3) through (7). Then, a simplified mathematical curve of well completion efficiencies may be generated for varying levels of drawdown and depletion for the coupled physics limit.

Figure 8:
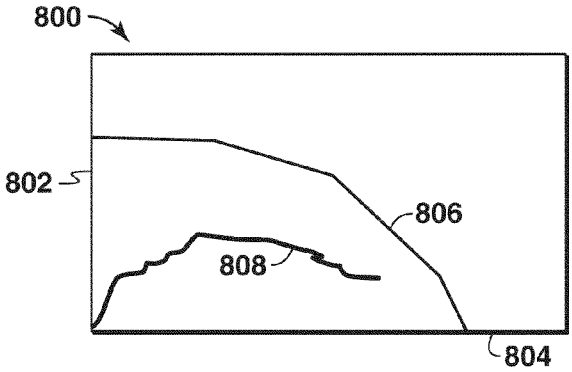
FIG. 8 is an exemplary chart of the drawdown versus depletion of the well in FIG. 1 in accordance with the present techniques.

As result of this process, FIG. 8 illustrates an exemplary chart of the drawdown verses the depletion of a well in accordance with the present techniques. In FIG. 8, a chart, which is generally referred to as reference numeral 800, compares the drawdown 802 to the depletion 804 of the well 103. In this example, the coupled physics limit may define a technical limit 806 generated from flow chart 700. As shown in the chart 800, the technical limit 806 may vary based on the relative values of the drawdown 802 to depletion 804. The well 103 remains productive as long as the well drawdown and depletion are constrained within the technical limit 806. The technical limit in this example represents the maximum pressure drawdown and depletion that a well may sustain before the well tubulars experience mechanical integrity problems causing well production failure when producing from a compacting reservoir formation. Alternatively, the technical limit 806 also may represent the maximum level of well drawdown and depletion for a given level of flow impairment caused by reservoir rock compaction related reduction in rock permeability when producing from a compacting reservoir formation. In another example scenario, the coupled physics limit may represent the combined technical limit on well performance for a given of flow impairment manifesting from the combined coupled physics of high rate non-Darcy flow occurring in combination with rock compaction induced permeability reduction.

Figure 9:
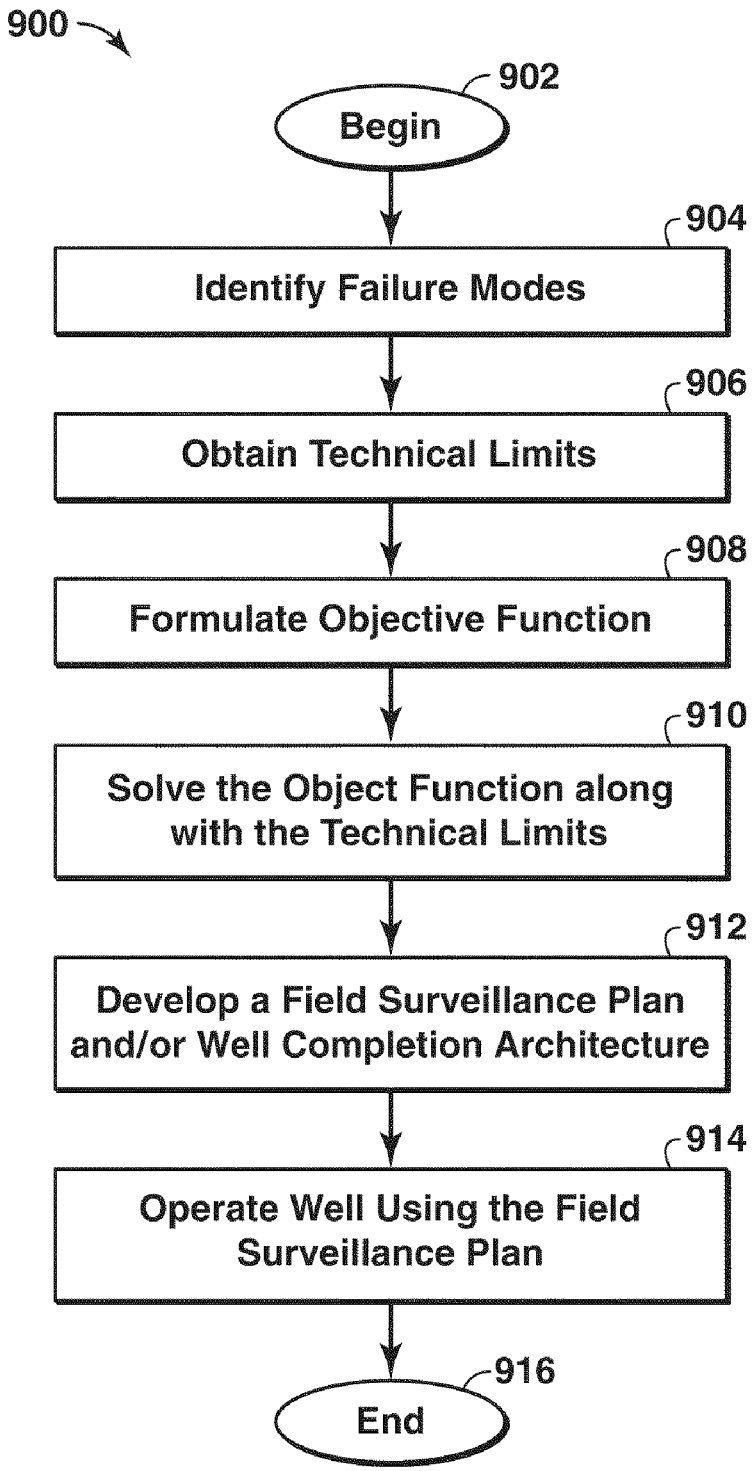
FIG. 9 is an exemplary flow chart of the optimization of technical limits in accordance with aspects of the present techniques.

Regardless of the technical limits, which may include the coupled physics limits, well operability limits, well producibility limits or other technical limits, the performance of the well may be optimized in view of the various technical limits for various reasons. FIG. 9 is an exemplary flow chart of the optimization of well operating conditions and/or well completion architecture with the user tool 212 of FIG. 2 or in accordance with the coupled physics limits tool 203 of FIG. 2 in accordance with aspects of the present techniques. In this flow chart, which is referred to by reference numeral 900, one or more technical limits may be combined and utilized to develop optimized well operating conditions over the life of a well or optimized well completion architecture to achieve optimized inflow profile along a well completion by completing the well in accordance with the well production technical limits. The well optimization process may be conducted during the field development planning stage, well design to evaluate various well completion types to achieve desired well performance consistent with technical limits during field development stage, identify root issues for under performance of well in everyday field surveillance and/or to perform hypothetical studies and Quantitative Risk Analysis (QRA) to quantify uncertainties in expected well performance. That is, the present technique may provide optimized well operating conditions over the life of the well or optimized well architecture (i.e., completion hardware) to be employed in well completion, which are based on various failure modes associated with one or more technical limits. Again, this optimization process may be performed by a user interacting with an application, such as the user tool 212 of FIG. 2, to optimize integrated well performance.

The flow chart begins at block 901. At blocks 902 and 904, the failure modes are identified and the technical limits are obtained. The failure modes and technical limits may include the failure modes discussed above along with the associated technical limits generated for those failure modes. In particular, the technical limits may include the coupled physics limit, well operability limit, and well producibility limit, as discussed above. At block 906, an objective function may be formulated. The objective function is a mathematical abstraction of a target goal that is to be optimized. For example, the objective function may include optimizing production for a well to develop a production path over the life-cycle of the well that is consistent with the technical limits. Alternatively, the objective function may include optimize of the inflow profile into the well completion based upon various technical limits that govern production from the formation along the length of the completion. At block 908, an optimization solver may be utilized to solve the optimization problem defined by the objective function along with the optimization constraints as defined by the various technical limits to provide an optimized solution or well performance. The specific situations may include a comparison of the well operability limit and well producibility limit or even the coupled physics limit, which includes multiple failure modes. For example, rock compaction related permeability loss, which leads to productivity impairment, may occur rapidly if pore collapse of the reservoir rock occurs. While, enhancing production rate is beneficial, flowing the well at rates that cause pore collapse may permanently damage the well and limit future production rates and recoveries. Accordingly, additional drawdown may be utilized to maintain production rate, which may be limited by the well operability limit that defines the mechanical failure limit for the well. Thus, the optimized solution may be the well drawdown and depletion over a well's life-cycle that simultaneously reduces well producibility risks due to flow impairment effects as a result of compaction related permeability loss and the well operability risks due to rock compaction, while maximizing initial rates and total recovery from the well. The previous discussion may also be applied to injection operating when injecting fluids and/or solids into a formation. In another optimization example, technical limits may be developed for inflow along the length of the completion from the various rock formations as intersected by the well completion. An objective function may be formulated to optimize the inflow profile for a given of amount of total production or injection rate for the well. Also, an optimization solver may be utilized to solve the optimization problem defined by this objective function along with the optimization constraints as defined by the various technical limits. This optimization solver may provide an optimized solution that is the optimized inflow profile consistent with desired well performance technical limits and target well production or injection rates.

Based on the solutions from the optimization solver, a field surveillance plan may be developed for the field, as shown in block 910 and discussed further below. The field surveillance plan may follow the optimization solution and technical limit constraints to provide the hydrocarbons in an efficient and enhanced manner. Alternatively, well completion architecture, i.e., completion type, hardware, and inflow control devices, may be designed and installed within well to manage well inflow in accordance with technical limits governing inflow from various formations into the well. Then, at block 912, the well may be utilized to produce hydrocarbons or inject fluids and/or solids in a manner that follows the surveillance plan to maintain operation within the technical limits. Accordingly, the process ends at block 914.

Beneficially, by optimizing the well performance, lost opportunities in the production of hydrocarbons or injection of fluids and/or solids may be reduced. Also, the operation of the well may be adjusted to prevent undesirable events and enhance the economics of a well over its life cycle. Further, present approach provides a technical basis for every day well operations, as opposed to the use to hog-laws, or other empirical rules that are based on faulty assumptions.

As a specific example, the well 103 may be a cased-hole completion, which is a continuation of the example discussed above with reference to the processes of FIGS. 3 and 5. As previously discussed, the well operability limits and well producibility limits may be obtained from the processes discussed in FIGS. 3-6B or a coupled physics limit may be obtained as discussed in FIGS. 7-8. Regardless of the source, the technical limits are accessed for use in defining the optimization constraints. Further, any desired Objective Function from well/field economics perspective may be employed. The objective function may include maximizing the well production rate, or optimize well inflow profile, etc. Accordingly, to optimize the well production rate, the well operability limit and well producibility limit may be simultaneously employed as constraints to develop optimal well drawdown and depletion history over the well's life cycle. Well operating conditions developed in this manner may systematically manage the risk of well mechanical integrity failures, while reducing the potential impact of various flow impairment modes on well flow capacity. Alternatively, to optimize the inflow profile into the well completion, the well operability limit and well producibility limit for each formation layer as intersected by the well completion may be simultaneously employed as constraints to develop the optimal inflow profile along the length of the completion over a well's life cycle. This optimal inflow profile is used to develop well completion architecture, i.e., well completion type, hardware, and inflow control devices that enable production or injection using the optimized flow conditions.

With the optimized solution to the objective function and the technical limits, a field surveillance plan is developed. The field surveillance may include monitoring of data such as measured surface pressures or the downhole flowing bottom hole pressures, estimates of static shut-in bottom hole pressures, or any other surface or downhole physical data measurements, such as temperature, pressures, individual fluid phase rates, flow rates, etc. These measurements may be obtained from surface or bottom hole pressure gauges, such as distributed temperature fiber optic cables, single point temperature gauges, flow meters, and/or any other real time surface or downhole physical data measurement device that may be utilized to determine the drawdown, depletion, and production rates from each formation layers in the well. Accordingly, the field surveillance plan may include instruments, such as, but not limited to, bottom hole pressure gauges, which are installed permanently downhole or run over a wireline. Also, fiber-optic temperature measurements and other devices may be distributed over the length of the well completion to transmit the real time data measurements to a central computing server for use by engineer to adjust well production operating conditions as per the field surveillance plan. That is, the field surveillance plan may indicate that field engineers or personnel should review well drawdown and depletion or other well producing conditions on a daily basis against a set target level to maintain the optimized well's performance.

Figure 10A:
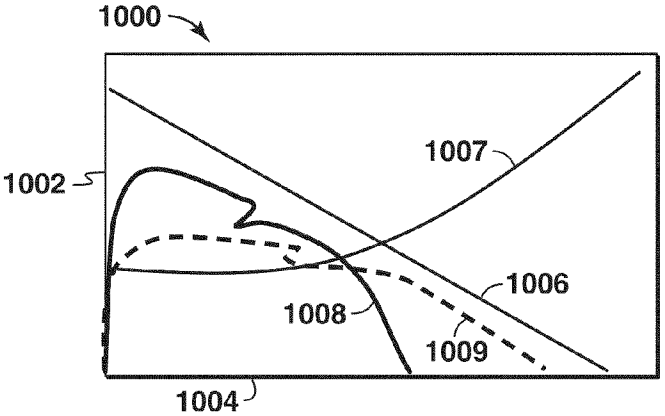
FIGS. 10A-10C are exemplary charts of the performance optimization of the well of FIG. 1 in accordance with the present techniques.
Figure 10B:
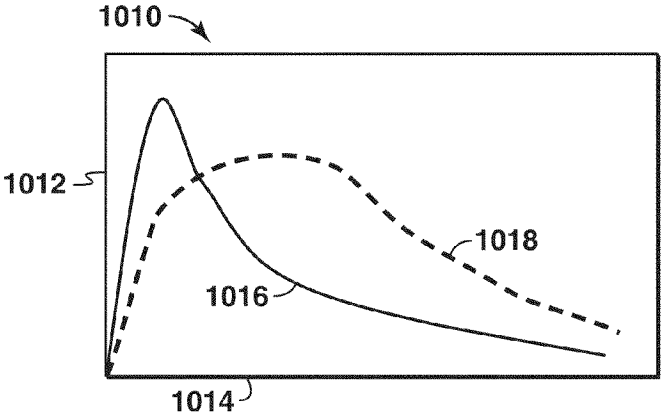
Figure 10C:
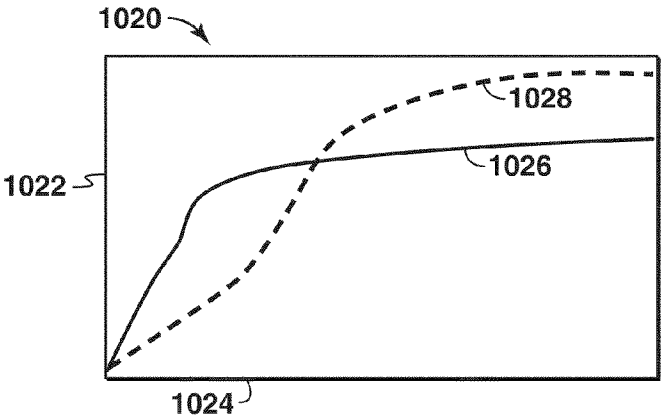

FIGS. 10A-10C illustrate exemplary charts associated with the optimization of the well of FIG. 1 in accordance with the present techniques. In particular, FIG. 10A compares the well operability limit with the well producibility limit of a well for well drawdown 1002 versus well depletion 1004 in accordance with the present techniques. In FIG. 10A, a chart, which is generally referred to as reference numeral 1000, compares well operability limit 1006, as discussed in FIG. 4, with the well producibility limit 1007 of FIG. 6A. In this example, a non-optimized or typical production path 1008 and an optimized integrated well performance production path 1009 are provided. The non-optimized production path 1008 may enhance the day-to-day production based on a single limit state, such as the well operability limit, while the IWP production path 1009 may be an optimized production path that is based on the solution to the optimization problem using the objective function and the technical limits discussed above. The immediate benefits of the integrated well performance production path 1009 over the non-optimized production path 1008 are not immediately evident by looking at the drawdown versus the depletion alone.

In FIG. 10B, a chart, which is generally referred to as reference numeral 1010, compares the production rate 1012 with time 1014 for the production paths. In this example, the non-optimized production path 1016, which is associated with the production path 1008, and the IWP production path 1018, which is associated with the production path 1009, are represented by the production rate of the well over a period of operation for each production path. With the non-optimized production path 1016, the production rate is initially higher, but drops below the IWP production path 1018 over time. As a result, the IWP production path 1018 presents a longer plateau time and is economically advantageous.

In FIG. 10C, a chart, which is generally referred to as reference numeral 1020, compares the total bbl (barrels) 1022 with time 1024 for the production paths. In this example, the non-optimized production path 1026, which is associated with the production path 1008, and the IWP production path 1028, which is associated with the production path 1009, are represented by the total bbl from the well over a period of operation for each production path. With the non-optimized production path 1026, the total bbl is again initially higher than the IWP production path 1028, but the IWP production path 1028 produces more than the non-optimized production path 1026 over the time period. As a result, more hydrocarbons, such as oil, are produced over the same time interval as the non-optimized production path 1026, which results in the capture of more of the reserve for the IWP production path.

Alternatively, the optimization may use the coupled physics limit along with the objective function to optimize the well performance. For example, because economics of most of the deepwater well completions are sensitive to the initial plateau well production rates and length of the plateau time, the objective function may be maximizing the well production rate. Accordingly, a standard reservoir simulator may be used to develop a single well simulation model for the subject well whose performance is to be optimized (i.e. maximize the well production rate). The reservoir simulation model may rely on volumetric grid/cell discretization methods, which are based on the geologic model of the reservoir accessed by the well. The volumetric grid/cell discretization methods may be Finite Difference, Finite Volume, Finite Element based methods, or any other numerical method used for solving partial difference equations. The reservoir simulation model is used to predict the well production rate versus time for a given set of well operating conditions, such as drawdown and depletion. At a given level of drawdown and depletion, the well performance in the simulation model is constrained by the coupled physics limit developed in coupled physics process 700. Additional constraints on well performance, such as upper limit on the gas-oil-ratios (GOR), water-oil-rations (WOR), and the like, may also be employed as constraints in predicting and optimizing well performance. An optimization solver may be employed to solve the above optimization problem for computing the time history of well drawdown and depletion that maximizes the plateau well production rate. Then, a field surveillance plan may be developed and utilized, as discussed above.

While the present techniques of the invention may be susceptible to various modifications and alternative forms, the exemplary embodiments discussed above have been shown by way of example. However, it should again be understood that the invention is not intended to be limited to the particular embodiments disclosed herein. Indeed, the present techniques of the invention are to cover all modifications, equivalents, and alternatives falling within the spirit and scope of the invention as defined by the following appended claims.

What is claimed is:

1. A method comprising:

identifying a well failure mode;

constructing a numerical engineering model to describe an event that results in the failure mode, wherein the event is described in terms of at least one parameter;

converting at least two simulations from the numerical engineering model into a response surface that associates the event with a range of conditions for the at least one parameter related to the event;

selecting at least one coupled physics simulator that uses a computational simulation model based on first principle physical laws;

using the at least one coupled physics simulator with a processor to generate a coupled physics limit that comprises an algorithm that includes a combination of well operating conditions that are within the range of conditions covered by the response surface;

associating the response surface and the coupled physics limit with a user tool configured to provide the response surface for analysis of a well having parameter conditions within the range of conditions covered by the response surface.

2. The method of claim 1 comprising utilizing the response surface to develop a well operability limit.

3. The method of claim 1 wherein identifying the failure mode comprises determining when shear failure or tensile failure of rock associated with a well completion of the well produces sand.

4. The method of claim 1 wherein identifying the failure mode comprises determining when at least one of collapse, crushing, buckling, and shearing of the well will occur due to compaction of the reservoir rock as a result of hydrocarbon production.

5. The method of claim 1 comprising verifying the engineering model by comparing results of the numerical engineering model to results measured from a well having parameter conditions within the range of conditions covered by the response surface.

6. The method of claim 1 comprising verifying the response surface by comparing results generated by the user tool based on the response surface to results developed by the numerical engineering model.

7. The method of claim 1 comprising utilizing the response surface to aid in a plurality of designs during the concept selection phase of at least one well having parameter conditions within the range of conditions covered by the response surface.

8. The method of claim 1 comprising utilizing the response surface to aid in the detailed design phase of at least one well having parameter conditions within the range of conditions covered by the response surface.

9. The method of claim 1 comprising utilizing the response surface to manage the production rates based on a technical limit developed by the response surface.

10. The method of claim 1 comprising utilizing the response surface to manage reservoir drawdown and depletion based on a technical limit developed by the response surface.

11. The method of claim 1 comprising utilizing the response surface to develop a well producibility limit.

12. The method of claim 11 wherein identifying the failure mode comprises determining when pressure drop through a near-well completion and in a wellbore of the well hinder the flow of fluids into the wellbore.

13. The method of claim 11 wherein identifying the failure mode comprises determining when pressure drop resulting from flow impairment created by non-Darcy effects, compaction effects, near-well multi-phase flow effects, or near-well fines migrations effects reduces the flow of fluids from a formation into the well.

14. The method of claim 11 wherein identifying the failure mode comprises determining when pressure drop associated with other impairment modes hinder flow of fluids into a wellbore of the well.

15. The method of claim 1 comprising utilizing the response surface to develop a well injectibility limit.

16. The method of claim 1 comprising performing a parametric study on the numerical engineering model with a range of parameters to create the response surface.

17. The method of claim 16 wherein the parameters represent various physical properties about at least one of the well, the reservoir rock, the produced fluid, and the injected fluid.

18. The method of claim 17 wherein the physical properties comprise at least one of the geometry of perforations in production casing, the geometry of perforations in the cement lining, the geometry of perforations in the formation, geometry of fracture lengths, the geometry of various forms of well completion parameters, and any combination thereof.

19. The method of claim 16 wherein the parameters represent various physical properties associated with the flow of fluids into and inside the wellbore.

20. The method of claim 16 comprising reducing the parameters based upon an experimental design approach to simplify the parametric study.

21. The method of claim 16 comprising reducing the parameters based upon dimensional analysis to simplify the parametric study.

22. The method of claim 16 comprising reducing the parameters based upon automation scripts to facilitate model construction, simulation, and simulation data collection for the parametric study.

23. The method of claim 1 wherein a technical limit developed from the response surface is used in a reservoir simulator to simulate well inflow performance.

24. The method of claim 1 wherein the numerical engineering model comprises at least one engineering simulation model based on point or grid/cell based discretization methods.

25. The method of claim 1 wherein a technical limit developed from the response surface is utilized in a reservoir simulator to simulate well performance.

26. The method of claim 1 wherein a technical limit developed from the response surface is utilized in a well or a well completion simulator to simulate well performance.

27. An apparatus comprising:

a processor;

a memory coupled to the processor; and an application accessible by the processor and stored in the memory, wherein the application is configured to:

receive parameters associated with a failure mode of a well from a user;

utilize a previously generated response surface to provide a technical limit for the failure mode, wherein the previously generated response surface is based on at least one numerical engineering model that represents an event resulting in the failure mode;

using with the processor, at least one coupled physics simulator that uses a computational simulation model based on first principle physical laws to generate a coupled physics limit that comprises an algorithm that includes a combination of well operating conditions that are within the range of conditions covered by the response surface; and use both the previously generated response surface and the coupled physics limit to quantify the parameters associated with the failure mode of the well.

28. The apparatus of claim 27 wherein the technical limit comprises a well operability limit.

29. The apparatus of claim 27 wherein the application is configured to aid in evaluating a plurality of designs for another well during the concept selection phase.

30. The apparatus of claim 27 wherein the technical limit comprises a well producibility limit.

31. The apparatus of claim 27 wherein the technical limit comprises a well injectibility limit.

32. The apparatus of claim 27 wherein the previously generated response surface is based on a parametric study performed on the at least one numerical engineering model with a plurality of parameters.

33. The apparatus of claim 32 wherein each of the plurality of parameters represents a physical property for the well.

34. The apparatus of claim 32 wherein each of the plurality of parameters represents a physical property associated with the flow of fluids in the well completion of a well.

35. The apparatus of claim 27 wherein the technical limit is utilized to produce hydrocarbons from the well.

36. The apparatus of claim 27 wherein the output comprises a graphical image of the technical limit.

37. The apparatus of claim 27 wherein the previously generated response surfaces are stored in the memory.

38. A method associated with the production of hydrocarbons comprising:

identifying a well failure mode;

accessing a user tool to determine a technical limit related to the failure mode for a well; and utilizing both a coupled physics limit that comprises an algorithm that includes a combination of well operating conditions and a previously developed response surface associated with the user tool to provide the technical limit, wherein the previously developed response surface is based on at least two simulations of at least one numerical engineering model that represents an event resulting in the well failure mode, wherein the at least one numerical engineering model represents the event in terms of at least one parameter related to the event, wherein the response surface associates the event with a range of conditions for at least one parameter related to the event, and wherein the well for which the technical limit is determined has parameter conditions within the range of conditions covered by the response surface.

39. The method of claim 38 wherein the technical limit comprises a well operability limit.

40. The method of claim 38 comprising utilizing the previously developed response surface to aid in evaluating a plurality of designs for the well during the concept selection phase.

41. The method of claim 38 comprising utilizing the previously developed response surface to develop a well producibility limit.

42. The method of claim 38 wherein the technical limit comprises a well injectibility limit.

43. The method of claim 38 wherein the previously developed response surface is based on a parametric study performed on the at least one numerical engineering model with a plurality of parameters.

44. The method of claim 43 wherein each of the plurality of parameters represents a physical property for the well.

45. The method of claim 44 wherein the physical properties comprise at least one of the geometry of perforations in production casing, the geometry of perforations in the cement lining, and any combination thereof.

46. The method of claim 43 wherein each of the plurality of parameters represents a physical property associated with the flow of fluids in a well completion of the well.

47. The method of claim 38 comprising producing hydrocarbons from the well completion based on the technical limit.

48. The method of claim 38 comprising injecting solids or fluids into the well completion based on the technical limit.

49. A method associated with the production of hydrocarbons comprising:

identifying a failure mode for a well;

constructing a numerical engineering model to describe an event that results in the failure mode;

converting the numerical engineering model into a response surface; selecting at least one coupled physics simulator that uses a computational simulation model based on first principle physical laws;

using the at least one coupled physics simulator with a processor to generate a coupled physics limit that comprises an algorithm that includes a combination of well operating conditions that are within the range of conditions covered by the response surface;

associating the response surface and the coupled physics limit with a user tool configured to provide the response surface for analysis of another well.

* * * * *